US012203362B2

(12) United States Patent
Poitzsch et al.

(10) Patent No.: US 12,203,362 B2
(45) Date of Patent: Jan. 21, 2025

(54) INJECTING MULTIPLE TRACER TAG FLUIDS INTO A WELLBORE

(71) Applicant: Saudi Arabian Oil Company, Dhahran (SA)

(72) Inventors: Martin E. Poitzsch, Northumberland, NH (US); Karim Ismail, Boston, MA (US); Gawain Thomas, Shirley, MA (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/452,304

(22) Filed: Aug. 18, 2023

(65) Prior Publication Data

US 2023/0392496 A1 Dec. 7, 2023

Related U.S. Application Data

(62) Division of application No. 17/466,192, filed on Sep. 3, 2021, now Pat. No. 11,773,715.

(Continued)

(51) Int. Cl.
*E21B 47/11* (2012.01)
*E21B 49/00* (2006.01)

(52) U.S. Cl.
CPC ..... *E21B 47/11* (2020.05); *E21B 49/005* (2013.01)

(58) Field of Classification Search
CPC ..... E21B 47/11; E21B 49/005
See application file for complete search history.

(56) References Cited

U.S. PATENT DOCUMENTS 3,703,355 A 11/1972 Takahashi
3,834,122 A 9/1974 Allison et al.

(Continued)

FOREIGN PATENT DOCUMENTS

CA 2997608 4/2017
CA 2941370 7/2018

(Continued)

OTHER PUBLICATIONS

"Evolute Express User Guide," Biotage, 2016, Brochure, p. 3, p. 20-21, 36 pages.

(Continued)

*Primary Examiner* — Silvana C Runyan
(74) *Attorney, Agent, or Firm* — Fish & Richardson P.C.

(57) ABSTRACT

A method and a system for injecting multiple tracer tag fluids into the wellbore are described. The method includes determining multiple injection concentrations of multiple respective tracer tag fluids, determining an injection sequence of the tracer tag fluids into a wellbore, and injecting the tracer tag fluids into the wellbore according to the injection concentrations and the injection sequence. The tracer tag fluids include synthesized polymeric nanoparticles suspended in a solution. The synthesized polymeric nanoparticles are configured bind to a wellbore cutting. The synthesized polymeric nanoparticles are configured to undergo a thermal de-polymerization at a respective temperature and generate a unique mass spectra. The injection sequence includes an injection duration determined by a depth interval of the wellbore to be tagged by the synthesized polymeric nanoparticles and an injection pause to prevent mixing the multiple tracer tag fluids in the wellbore.

12 Claims, 5 Drawing Sheets

Related U.S. Application Data

(60) Provisional application No. 63/074,287, filed on Sep. 3, 2020.

(56) References Cited

U.S. PATENT DOCUMENTS 3,851,171 A 11/1974 Saniford
3,947,396 A 3/1976 Kangas et al.
4,137,452 A 1/1979 Paap
4,264,329 A 4/1981 Beckett
4,289,203 A 9/1981 Swanson
4,420,565 A 12/1983 Schmitt
4,485,071 A 11/1984 Larter
4,694,046 A 9/1987 Bock et al.
4,755,469 A 7/1988 Showalter
4,772,563 A 9/1988 Evangelista et al.
4,882,128 A 11/1989 Hukvari et al.
4,882,763 A 11/1989 Buchan et al.
5,124,268 A 6/1992 Dakubu
5,168,927 A 12/1992 Stegenneier
5,180,556 A 1/1993 Nolte et al.
5,390,529 A 2/1995 Ghiselli
5,990,224 A 11/1999 Raynolds et al.
6,226,390 B1 5/2001 Deruyter et al.
6,250,848 B1 6/2001 Moridis et al.
6,252,016 B1 6/2001 Wu et al.
6,331,436 B1 12/2001 Richardson
6,488,872 B1 12/2002 Beebe et al.
6,585,044 B2 7/2003 Rester
6,590,647 B2 7/2003 Stephenson
6,691,780 B2 2/2004 Nguyen et al.
7,032,662 B2 4/2006 Malone
7,033,975 B2 4/2006 Baran, Jr. et al.
7,249,009 B2 7/2007 Ferworn et al.
7,289,942 B2 10/2007 Yang et al.
7,303,006 B2 12/2007 Stone
7,373,073 B2 5/2008 Kamp et al.
7,472,748 B2 1/2009 Gdanski et al.
7,520,933 B2 4/2009 Park et al.
7,526,953 B2 5/2009 Goodwin et al.
7,588,827 B2 9/2009 Nie et al.
7,810,563 B2 10/2010 Buijse et al.
7,875,654 B2 1/2011 Hong et al.
7,879,625 B1 2/2011 Boss
7,920,970 B2 4/2011 Zuo et al.
8,028,562 B2 10/2011 Shah et al.
8,062,418 B2 11/2011 Costantz et al.
8,148,477 B2 4/2012 Saita et al.
8,176,981 B2 5/2012 Savu et al.
8,187,554 B2 5/2012 Panagiotou
8,269,501 B2 9/2012 Schmidt et al.
8,337,783 B2 12/2012 Locascio et al.
8,418,759 B2 4/2013 Moore et al.
8,507,844 B2 8/2013 Mazza
8,627,902 B2 1/2014 Hammer
8,629,089 B2 1/2014 Dams
8,638,104 B2 1/2014 Barber et al.
8,722,812 B2 5/2014 Yabu et al.
8,821,806 B2 9/2014 Hersherwitz et al.
8,877,954 B2 11/2014 Giesenberg et al.
8,996,346 B2 3/2015 Zuo et al.
9,023,966 B2 5/2015 Zhang et al.
9,050,655 B2 6/2015 Chou
9,080,097 B2 7/2015 Gupta et al.
9,121,271 B2 9/2015 Shook
9,133,709 B2 9/2015 Huh et al.
9,200,102 B2 12/2015 Baran, Jr. et al.
9,227,929 B2 1/2016 Winter et al.
9,279,771 B2 3/2016 Aizenberg et al.
9,296,851 B2 3/2016 Luettgen
9,366,099 B2 6/2016 Ly
9,375,790 B2 6/2016 Murphy et al.
9,481,764 B1 11/2016 Kinlen
9,534,062 B2 1/2017 He et al.
9,592,555 B2 3/2017 Schut et al.
9,624,422 B2 4/2017 Dams et al.
9,664,665 B2 5/2017 Gisolf et al.
9,708,525 B2 7/2017 Suresh et al.
9,719,009 B2 8/2017 Jangda et al.
9,809,740 B2 11/2017 Chakraborty et al.
9,873,622 B2 1/2018 Kang et al.
9,873,827 B2 1/2018 Chakraborty et al.
10,273,399 B2 4/2019 Cox
10,308,865 B2 6/2019 Cox
10,308,895 B2 6/2019 Vidal et al.
10,316,873 B2 6/2019 Weitz et al.
10,392,555 B2 8/2019 Giro et al.
10,421,894 B2 9/2019 Johnson et al.
10,436,003 B2 10/2019 Kim et al.
10,458,207 B1 10/2019 Matringe et al.
10,487,259 B2 11/2019 Cox
10,611,967 B2 4/2020 Inan
10,858,931 B2 12/2020 Chen et al.
2001/0036667 A1 11/2001 Tayebi
2002/0026000 A1 2/2002 Varadaraj et al.
2003/0220204 A1 11/2003 Baran et al.
2004/0108110 A1 6/2004 Zupanick et al.
2004/0143059 A1 7/2004 Cabrera et al.
2005/0080209 A1 4/2005 Blankenship
2005/0252286 A1 11/2005 Ibrahim et al.
2006/0088476 A1 4/2006 Harder
2006/0105052 A1 5/2006 Acar et al.
2006/0120683 A1 6/2006 Kamp et al.
2007/0114030 A1 5/2007 Todd et al.
2007/0119244 A1 5/2007 Goodwin et al.
2008/0019921 A1 1/2008 Zhang
2008/0110253 A1 5/2008 Stephenson et al.
2008/0111064 A1 5/2008 Andrews et al.
2008/0206317 A1 8/2008 Johnsson
2008/0220970 A1 9/2008 Martin
2009/0087911 A1 4/2009 Rogerio
2009/0087912 A1 4/2009 Ramos et al.
2009/0173253 A1 7/2009 Roesch et al.
2009/0174117 A1 7/2009 Winkler et al.
2009/0248309 A1 10/2009 Nelville et al.
2009/0253595 A1 10/2009 Qu
2009/0277625 A1 11/2009 Bai et al.
2010/0049625 A1 2/2010 Biebesheimer et al.
2010/0068821 A1 3/2010 St. Germain
2010/0092865 A1 4/2010 Kanno et al.
2010/0224823 A1 9/2010 Yin et al.
2010/0270020 A1 10/2010 Baran et al.
2010/0290999 A1 11/2010 Kim
2010/0305219 A1 12/2010 Granick et al.
2010/0307745 A1 12/2010 Lafitte
2011/0012331 A1 1/2011 Kim
2011/0030949 A1 2/2011 Weaver et al.
2011/0129424 A1 6/2011 Berkland et al.
2011/0207231 A1 8/2011 Natan et al.
2011/0239754 A1 10/2011 Dyer
2011/0260051 A1 10/2011 Preudhomme et al.
2011/0275061 A1 11/2011 Weidemaier et al.
2011/0320128 A1 12/2011 Shook
2012/0062886 A1 3/2012 Piotti
2012/0115128 A1 5/2012 Miller
2012/0135080 A1 5/2012 Bromberg
2012/0175120 A1 7/2012 Holcomb et al.
2012/0178653 A1* 7/2012 McClung, III ..... E21B 47/11 977/734
2012/0193578 A1 8/2012 Pan et al.
2012/0257199 A1 10/2012 Liu et al.
2012/0261617 A1 10/2012 Pan et al.
2012/0325465 A1 12/2012 Hammer et al.
2013/0040292 A1 2/2013 Lopez et al.
2013/0084630 A1 4/2013 Rolland
2013/0084643 A1 4/2013 Commarieu et al.
2013/0087020 A1 4/2013 Brutchey et al.
2013/0087329 A1 4/2013 Hewitt
2013/0087340 A1 4/2013 Choens et al.
2013/0109261 A1 5/2013 Koene
2013/0126158 A1 5/2013 Gupta
2013/0172853 A1 7/2013 McClain
2013/0244914 A1 9/2013 Wu et al.
2013/0259808 A1 10/2013 Chen et al.
2013/0296453 A1 11/2013 Gicsenberg et al.

(56) References Cited

U.S. PATENT DOCUMENTS

| | | | |
|---|---|---|---|
| 2013/0312970 | A1 | 11/2013 | Lafitte et al. |
| 2013/0341030 | A1 | 12/2013 | Brannon et al. |
| 2014/0060832 | A1 | 3/2014 | Mahoney et al. |
| 2014/0077121 | A1 | 3/2014 | Sun et al. |
| 2014/0122047 | A1 | 5/2014 | Saldivar et al. |
| 2014/0186939 | A1 | 7/2014 | Peterman et al. |
| 2014/0190700 | A1 | 7/2014 | Tang et al. |
| 2014/0208825 | A1 | 7/2014 | Holba et al. |
| 2014/0231077 | A1 | 8/2014 | Rivero et al. |
| 2014/0260694 | A1 | 9/2014 | Szlendak |
| 2014/0323363 | A1 | 10/2014 | Perriat |
| 2014/0360973 | A1 | 12/2014 | Yin et al. |
| 2015/0001385 | A1 | 1/2015 | Perriat et al. |
| 2015/0013983 | A1 | 1/2015 | Alwattari |
| 2015/0038347 | A1 | 2/2015 | Johnson et al. |
| 2015/0050741 | A1 | 2/2015 | Tour et al. |
| 2015/0079270 | A1 | 3/2015 | Wang et al. |
| 2015/0118501 | A1 | 4/2015 | Lu |
| 2015/0132543 | A1 | 5/2015 | Nouzille et al. |
| 2015/0132742 | A1 | 5/2015 | Thou et al. |
| 2015/0148269 | A1 | 5/2015 | Tamsilian |
| 2015/0153472 | A1 | 6/2015 | Tour |
| 2015/0159079 | A1 | 6/2015 | Huh et al. |
| 2015/0175876 | A1 | 6/2015 | Resasco et al. |
| 2015/0232748 | A1 | 8/2015 | Kanj et al. |
| 2015/0268370 | A1 | 9/2015 | Johnston et al. |
| 2015/0284811 | A1* | 10/2015 | Knight ..... G16B 20/00 506/8 |
| 2015/0299369 | A1 | 10/2015 | Ausserre et al. |
| 2015/0368547 | A1 | 12/2015 | Lesko et al. |
| 2015/0376493 | A1 | 12/2015 | Huh et al. |
| 2016/0003040 | A1 | 1/2016 | Jessheim et al. |
| 2016/0016166 | A1 | 1/2016 | Rolland et al. |
| 2016/0040514 | A1 | 2/2016 | Rahmani et al. |
| 2016/0061020 | A1 | 3/2016 | Sayarpour |
| 2016/0061790 | A1 | 3/2016 | Zhang |
| 2016/0075937 | A1 | 3/2016 | Cannan |
| 2016/0083641 | A1 | 3/2016 | Gamage |
| 2016/0097750 | A1 | 4/2016 | Van Herzen |
| 2016/0129371 | A1 | 5/2016 | Black |
| 2016/0251571 | A1 | 9/2016 | Agrawal et al. |
| 2016/0264846 | A1 | 9/2016 | Bennetzen et al. |
| 2016/0340569 | A1 | 11/2016 | Belcher |
| 2017/0059668 | A1 | 3/2017 | Chang et al. |
| 2017/0067322 | A1 | 3/2017 | Wong |
| 2017/0107812 | A1 | 4/2017 | Shang |
| 2017/0173546 | A1 | 6/2017 | Cheng et al. |
| 2017/0199124 | A1 | 7/2017 | Bolduc et al. |
| 2018/0201644 | A1 | 7/2018 | Kulak et al. |
| 2018/0275114 | A1 | 9/2018 | Kosynkin |
| 2018/0369808 | A1 | 12/2018 | Wronko |
| 2019/0016943 | A1 | 1/2019 | Ren et al. |
| 2019/0112914 | A1 | 4/2019 | Chen |
| 2019/0118175 | A1 | 4/2019 | Kim et al. |
| 2019/0211324 | A1* | 7/2019 | Zografos ..... B05B 12/1418 |
| 2019/0218907 | A1 | 7/2019 | Ow et al. |
| 2019/0226326 | A1 | 7/2019 | Ow et al. |
| 2019/0368336 | A1 | 12/2019 | Hammond et al. |
| 2020/0116019 | A1 | 4/2020 | Ow et al. |
| 2020/0377626 | A1 | 12/2020 | Ow et al. |
| 2020/0408089 | A1 | 12/2020 | Ow et al. |
| 2021/0025858 | A1 | 1/2021 | Ow et al. |

FOREIGN PATENT DOCUMENTS

| | | |
|---|---|---|
| CA | 2916567 | 8/2019 |
| CN | 101475667 | 7/2009 |
| CN | 102649831 | 8/2012 |
| CN | 103160265 | 6/2013 |
| CN | 103267825 | 8/2013 |
| CN | 103275270 | 9/2013 |
| CN | 103352255 | 10/2013 |
| CN | 102586873 | 12/2014 |
| CN | 104616350 | 5/2015 |
| CN | 107915802 | 4/2018 |
| CN | 108930535 | 12/2018 |
| EP | 0171978 | 11/1990 |
| EP | 1721603 | 11/2006 |
| EP | 2004573 | 12/2008 |
| EP | 2040075 | 3/2009 |
| EP | 2104082 | 9/2009 |
| EP | 1404776 | 11/2012 |
| EP | 2480625 | 4/2013 |
| EP | 2480626 | 4/2013 |
| EP | 3444028 | 2/2019 |
| FR | 2756046 | 5/1998 |
| FR | 2928484 | 9/2009 |
| GB | 2161269 | 8/1988 |
| GB | 2489714 | 10/2012 |
| KR | 20170131731 | 11/2017 |
| KR | 101852925 | 4/2018 |
| WO | WO 1999038931 | 8/1999 |
| WO | WO 2002102917 | 12/2002 |
| WO | WO 2003100214 | 12/2003 |
| WO | WO 2004095259 | 11/2004 |
| WO | WO 2007124814 | 11/2007 |
| WO | WO 2008034553 | 3/2008 |
| WO | WO 2010138914 | 12/2010 |
| WO | WO 2011035294 | 3/2011 |
| WO | WO 2011063023 | 5/2011 |
| WO | WO 2011081681 | 7/2011 |
| WO | WO 2011035292 | 10/2011 |
| WO | WO 2012052148 | 4/2012 |
| WO | WO 2012154332 | 11/2012 |
| WO | WO 2012158478 | 11/2012 |
| WO | WO 2013142869 | 9/2013 |
| WO | WO 2014008496 | 1/2014 |
| WO | WO 2014014919 | 1/2014 |
| WO | WO 2014066793 | 5/2014 |
| WO | WO 2014179020 | 11/2014 |
| WO | WO 2014207075 | 12/2014 |
| WO | WO 2015044446 | 4/2015 |
| WO | WO 2015058206 | 4/2015 |
| WO | WO 2015097116 | 7/2015 |
| WO | WO 2015200060 | 12/2015 |
| WO | WO 2016016335 | 2/2016 |
| WO | WO 2016087397 | 6/2016 |
| WO | WO 2016174413 | 11/2016 |
| WO | WO 2017015120 | 1/2017 |
| WO | WO 2017136641 | 8/2017 |
| WO | WO 2017164822 | 9/2017 |
| WO | WO 2017210424 | 12/2017 |
| WO | WO 2018085504 | 5/2018 |
| WO | WO 2018175763 | 9/2018 |
| WO | WO 2018234431 | 12/2018 |
| WO | WO 2019027817 | 2/2019 |
| WO | WO 2019063100 | 4/2019 |
| WO | WO 2019164511 | 8/2019 |
| WO | WO 2020081426 | 4/2020 |

OTHER PUBLICATIONS

"Method Development Guidelines: Solid Phase Extraction Using ISOLUTE® ENV+ for the Extraction of Aqueous Samples," Biotage, 2020, 3 pages.

"SPE columns, Chromabond HR-XAW, 85 µm, 1 mL/100 mg," Macherey-Nagel, available on or before Nov. 18, 2020, retrieved on Dec. 1, 2021, retrieved from URL <https://www.mn-net.com/us/spe-columns-chromabond-hr-xaw-85-m-1-ml/100-mg-730729>, 3 pages.

"Waters Corp Oasis WAX 6 cc Vac Cartridge, 500 mg Sorbent per Cartridge, 60 µm, 30/pk," Fisher Scientific, retrieved on Dec. 1, 2021, retrieved from URL <https://www.fishersci.com/shop/products/oasis-wax-cartridge-6cc-500mg/50466019>, 1 page.

"Agilent's New Mixed-Mode Anion Exchange Polymer Solid Phase Extraction Cartridges: SampliQ SAX," Agilent Technologies, Inc. 2008, Brochure, 4 pages.

"Optimizing Extraction of Multianalyte Suites from Water Samples Using Layered Solid Phase Extraction Columns," Biotage, Layered Solid Phase Extraction cols. 2016, Brochure, 4 pages.

(56) References Cited

OTHER PUBLICATIONS

Agenet et al., "Fluorescent Nanobeads: a First Step Toward Intelligent Water Tracers," SPE-157019, Society of Petroleum Engineers (SPE), presented at the SPE International Oilfield Nanotechnology Conference held in Noordwijk, the Netherlands, Jun. 12-14, 2012, 13 pages.
Alfazazi et al., "Screening of New HPAM Base Polymers for Applications in High Temperature and High Salinity Carbonate Reservoirs," SPE-192805-MS, presented at Abu Dhabi International Petroleum Exhibition & Conference, Society of Petroleum Engineers, Nov. 2018, 17 pages.
Allard and Larpent, "Core-shell type dually fluorescent polymer nanoparticles for ratiometric pH-sensing," J. Polym. Sci., Part A: Polym. Chem. 46:18 (6206-6213), 2008, 8 pages.
Al-Muntasheri et al., "Nanoparticle-Enhanced Hydraulic-Fracturing Fluids: A Review," SPE185161-PA, Society of Petroleum Engineers (SPE), SPE Production & Operations 32:02, May 2017, 10 pages.
Anbari et al., "Microfluidic Model Porous Media: Fabrication and Applications," Nano Micro Small, Special Issue: Multi-Scale Pores and Channels, May 3, 2018, 14:18 (1703575), 15 pages.
Anisimov, "The Use of Tracers for Reservoir Characterization," SPE 118862, Society of Petroleum Engineers (SPE), presented at SPE Middle East Oil and Gas Show and Conference, Mar. 15-18, 2009, 8 pages.
Armelao et al., "Design of luminescent lanthanide complexes: From molecules to highly efficient photo-emitting materials," Coordination Chemistry Reviews, 254: 487-505, Mar. 2010, 19 pages.
Armstrong et al., "Artificial opal photonic crystals and inverse opal structures—fundamentals and applications from optics to energy storage," Journal of Materials Chemistry C, May 2015, 3: 6109-6143, 35 pages.
Asadi et al., "Application of Chemical Tracers in IOR: A Case History," SPE-126029-MS, Society of Petroleum Engineers (SPE), presented at the SPE North African Technical Conference and Exhibition, Feb. 14-17, 2010, 11 pages.
Aslan et al., "Fluorescent Core-Shell AG@$SiO_2$ Nanocomposites for Metal-Enhanced Fluorescence and Single Nanoparticle Sensing Platforms," JACS Communications, J. Am. Chem. Soc. 129: 1524-1525, Jan. 19, 2007, 2 pages.
Atarita et al., "Predicting Distribution of Total Organic Carbon (TOC) and S2 with A Log Resistivity and Acoustic Impedance Inversion on Talang Akar Formation, Cipunegara Sub Basin, West Java," Procedia Engineering, 2017, 170: 390-397, 8 pages.
Badgett et al., "Totalsynthese eines Neobetanidin-Derivates und des Neobetenamins," Helvetica Chimica Acta 53(2): 433-448, 1970, 16 pages, English Summary.
Bagaria et al., "Iron Oxide Nanoparticles Grafted with Sulfonated Copolymers are Stable in Concentrated Brine at Elevated Temperatures and Weakly Adsorb on Silica," ACS Applied Materials & Interfaces, vol. 5, No. 8 (3329-3339), Mar. 25, 2013, 11 pages.
Bala et al., "Interaction of Different Metal Ions with Carboxylic Acid Group: A Quantitative Study," The Journal of Physical Chemistry A, 111:28 (6183-6190), Jun. 2007, 8 pages.
Bao et al., "Luminescence properties of the co-luminescence groups of Sm-La-pyridyl carboxylic acids, " Journal of Rare Earths 30:4 (320-324), Apr. 2012, 5 pages.
Behnke et al., "Encapsulation of Hydrophobic Dyes in Polystyrene Micro- and Nanoparticles via Swelling Procedures." J. Fluoresc. 21(3): 937-944, 2011, 8 pages.
Benninger et al., "Time-resolved fluorescence imaging of solvent interaction in microfluidic devices," Optics Express, Sep. 2005, 11 pages.
Blanz et al., "Nuclear Magnetic Resonance Logging While Drilling (NMR-LWD): From an Experiment to a Day-to-Day Service for the Oil Industry," Diffusion Fundamentals, 2010, 14(2), 5 pages.
Borrini et al., "Water Soluble PDCA Derivatives for Selective Ln(III)/An(III) and Am(III)/Cm(III) Separation," Solvent Extraction and Ion Exchange 33:3 (224-235), Oct. 2014, 30 pages.
Boyjoo et al., "Synthesis of micro and nano-sized calcium carbonate particles and their applications," Journal of Materials Chemistry A, 2014, 2: 14270-14288, 19 pages.
Brichart et al., "The Use of Fluorescent Tracers for Inhibitor Concentration Monitoring Useful for Scale Inhibitor," IPTC-17933-MS, International Petroleum Technology Conference, presented at the International Petroleum Technology Conference held in Kuala Lumpur, Dec. 10-12, 2014, 8 pages.
Buchgraber et al., "Creation of a dual-porosity micromodel for pore-level visualization of multiphase flow," J. Petrol. Sci. Eng., 2012, 86-87: 27-38, 12 pages.
Bunzli and Piguet, "Taking advantage of luminescent lanthanide ions," Chemical Society Reviews, 34:12 (1048-1077), Sep. 2005, 30 pages.
Chang et al., "Magnetic SERS Composite Nanoparticles for Microfluidic Detection," 251st ACS National Mecting, Mar. 13-17, 2016, 1 pages, abstract only.
Chen et al., "Aggregation Kinetics of Alginate-Coated Hematite Nanoparticles in Monovalent and Divalent Electrolytes," Environmental Science & Technology, 40:5 (1516-1523), Mar. 2006, 8 pages.
Chen et al., "Analysis of the solution conformations of T4 lysozyme by paramagnetic NMR spectroscopy," The Royal Society of Chemistry, Physical Chemistry Chemical Physics (PCCP) 18:8 (5850-5859), 2016, 10 pages.
Chen et al., "Hydration Repulsion between Carbohydrate Surfaces Mediated by Temperature and Specific Ions," Scientific Reports, vol. 6 (1-10), Jun. 23, 2016, 10 pages.
Chen et al., "Impact of Irreversible Retention on Tracer Deployments; Constraining Novel Material Deployments," SPE 188890-MS, Society of Petroleum Engineers (SPE), presented at the SPE Abu Dhabi International Petroleum Exhibition and Conference, Nov. 2017, 8 pages.
Chen et al., "Improved Reservoir History Matching and Production Optimization with Tracer Data," SPE 191523-MS, Society of Petroleum Engineers (SPE), presented at the SPE Annual Technical Conference and Exhibition, Sep. 2018, 15 pages.
Chen et al., "Semicontinuous Monomer-Starved Emulsion Polymerization as a Means to Produce Nanolatexes: Analysis of Nucleation Stage," Langmuir, 29: 5650-5658, 2013, 9 pages.
Chen et al., "FITC functionalized magnetic core-shell $Fe_3O_4$/Ag hybrid nanoparticle for selective determination of molecular biothiols," Sensorts and Actuators B: Chemical 193: 857-863, 2014, 7 pages.
Christy et al., "Characterization of Natural Organic Matter by Pyrolysis/GC-MS," Environment International, 25, 1999, 9 pages.
Chuang et al., "Ultra-sensitive in-situ detection of novel near-infrared persistent luminescent tracer nanoagents in crude oil-water mixtures," A Nature Research Journal, Scientific Reports, Jun. 15, 2016, 5 pages.
Clark et al., "Water-Soluble Fluorochemical Surfactant Well Stimulation Additives," SPE9008, Society of Petroleum Engineers (SPE), Journal of Petroleum Technology, 34:07, Jul. 1982, 5 pages.
Clough et al., "Characterization of Kerogen and Source Rock Maturation Using Solid-State NMR Spectroscopy," Energy & Fuels, 2015, 29(10): 6370-6382, 42 pages.
Coates et al., "Enhancement of luminescence of europium(m) ions in water by use of synergistic chelation. Part 1.1:1 and 2:1 complexes," J. Chem. Soc., Perkin Trans. 2 (1275-1282), Jan. 1996, 8 pages.
Cole et al., "Polyethylene Glycol Modified, Cross-Linked Starch-Coated Iron Oxide Nanoparticles for Enhanced Magnetic tumor Targeting," Biomaterials, 32:8 (2183-2193), Mar. 1, 2011, 11 pages.
coleparmer.com [online] "Kinesis TELOS® Multilayer SPE Columns," Cole-Parmer, available on or before 2021, retrieved on Nov. 17, 2021, retrieved from URL<https://www.coleparmer.com/p/kinesis-telos-multilayer-spe-columns/71662>, 3 pages.
Constantin and Davidson, "Lamellar La mesophases doped with inorganic nanoparticles," MINIREVIEW, Chem. Phys. Chem. 15: 1270-1282, 2014, 12 pages.
Corning Incorporated, "12.10G1 Fluidic Modules Description," in 09-CD, MG1 HP Instruction Manual, 5 ed .; Corning, Ed. 78-79, 2016, 2 pages.

(56) References Cited

OTHER PUBLICATIONS

Corning, "The future flows through Corning Advanced Flow-Reactors," G1 Reactor. Corning, Ed. 2016, 3 pages.
Cox et al., "Pyrolyzable Nanoparticle Tracers for Environmental Interrogation and Monitoring," ACS Appl. Mater. Interfaces 9, 2017, 10 pages.
Cubillos et al., "The Value of Inter-well and Single Well Tracer Technology for De-Risking and Optimizing a CEOR Process—Caracara Field Case," SPE 174394-MS, Society of Petroleum Engineers (SPE), presented at the EUROPEC 2015, Jun. 1-4, 2015, 19 pages.
Das et al., "Molecular Fluorescence, Phosphorescence, and Chemiluminescence Spectrometry," American Chemical Society (ACS Publications), Analytical Chemistry 84: S7-625, Nov. 3, 2011, 29 pages.
Deans, "Using Chemical Tracers To Measure Fractional Flow And Saturation In-Situ," SPE-7076, Society of Petroleum Engineers (SPE), presented at SPE Symposium on improved Methods of Oil Recovery, Apr. 16-17, 1978, 10 pages.
Deschamps et al., "Drilling to the Extreme: the Micro-Coring Bit Concept," IADC/SPE 115187, Society of Petroleum Engineers (SPE), International Association of Drilling Contractors (IADC), presented at the IADC/SPE Asia Pacific Drilling Technology Conference and Exhibition, Aug. 25-27, 2008, 12 pages.
Desmette et al., "Drilling Hard and Abrasive Rock Efficiently, or Generating Quality Cuttings? You No Longer Have to Choose . . . ," SPE 116554, Society of Petroleum Engineers (SPE), presented at the 2008 SPE Annual Technical Conference and Exhibition, Sep. 21-24, 2008, 19 pages.
Doda et al., "Investigation of Alkali Resistant Polymer for Improved Heavy Oil Recovery," SPE 165514, Society of Petroleum Engineers (SPE), presented at SPE Heavy Oil Conference-Canada, Jun. 11-13, 2013, 15 pages.
Du and Guan, "Interwell tracer tests: lessons learned from past field studies," SPE 93140-MS, Society of Petroleum Engineers (SPE), presented at the SPE Asia Pacific Oil and Gas Conference and Exhibition, Apr. 5-7, 2005, 9 pages.
Duan et al., "Review article: Fabrication of nanofluidic devices," Biomicrofluidics, Mar. 2013, 7:2 (026501), 42 pages.
Ducros, "Source Rocks of the Middle East," Source Rock Kinetics: Goal and Perspectives. AAPG Geosciences Technology Workshop, Jul. 2016, 30 pages.
Dugstad, "Chapter 6: Well-to-well tracer tests," in Petroleum Engineering Handbook, 5: 651-683, 2007, 31 pages.
Edwards et al., "Extending the distance range accessed with continuous wave EPR with Gd3+ spin probes at high magnetic fields," The Royal Society of Chemistry, Physical Chemistry Chemical Physics (PCCP) 15:27 (11313-11326), 2013, 14 pages.
El-Aneed et al., "Mass Spectrometry, Review of the Basics: Electrospray, MALDI, and Commonly Used Mass Analyzers," Applied Spectroscopy Reviews 44:3 (210-230), Mar. 16, 2009, 22 pages.
Esmaeilzadeh et al., "Effect of ZrO2 nanoparticles on the interfacial behavior of surfactant solutions at airwater and n-heptane-water interfaces," Fluid Phase Equilibria, 2014, 361, 289-295, 7 pages.
Esumi et al., "Interaction between Zwitterionic Fluorocarbon and Anionic Surfactants in Aqueous Solutions," Langmuir, 9(358-360), 1993, 3 pages.
Fernández et al., "Evaluation of Cationic Water-Soluble Polymers With Improved Thermal Stability," SPE 93003, Society of Petroleum Engineers (SPE), presented at SPE International Symposium on Oilfield Chemistry, Society of Petroleum Engineers, Feb. 2005, 13 pages.
Fichtel et al., "A highly sensitive HPLC method for determination of nanomolar concentrations of dipicolinic acid, a characteristic constituent of bacterial endospores," Journal of Microbiological Methods, 2007, 70: 319-327, 9 pages.
Freeze and Cherry, "Chapter 9: Groundwater Contamination," in Groundwater, Englewood Cliffs, NJ: Prentice-Hall, Inc., 1979, 80 pages.
Gaillard et al., "New Water Soluble Anionic NVP Acrylamide Terpolymers for Use in Harsh EOR Conditions," SPE-169108-MS, Society of Petroleum Engineers (SPE), presented at SPE Improved Oil Recovery Symposium, Apr. 12-14, 2014, 18 pages.
Gaillard et al., "Selection of Customized Polymers to Enhance Oil Recovery from High Temperature Reservoirs," SPE-177073-MS, presented at the SPE Latin American and Caribbean Petroleum Engineering Conference, Society of Petroleum Engineers, Nov. 2015, 15 pages.
Galdiga and Greibrokk, "Ultra-trace determination of flurinated aromatic carboxylic acids in aqueous reservoir fluids using solid-phase extraction in combination with gas chromatography-mass spectrometry," Journal of Chromatography A 793:2 (297-306), Jan. 16, 1998, 10 pages.
Gao et al., "A Surface Functional Monomer-Directing Strategy for Highly Dense Imprinting of TNT at Surface of Silica Nanoparticles," JACS Communications, Journal of American Chemical Society 129:25 (7859-7866), Jun. 2007, 8 pages.
Gardiner et al., "Chapter 1: Introduction to Raman Scattering," in Practical Raman Spectroscopy, Springer-Verlag, 1989, 9 pages.
George et al., "Modified Dipicolinic Acid Ligands for Sensitation and Europium (III) Luminescence," Inorganic Chemistry 45:4 (1739-1744), Feb. 1, 2006, 6 pages.
Georgi, et al., "Advances in Cuttings Collection and Analysis," SPWLA 34th Annual Logging Symposium, Jun. 13-16, 1993, 20 pages.
Gerami et al., "Microfluidics for Porous Systems: Fabrication, Microscopy and Applications," Transport in Porous Media, 2019, 130: 277-304, 28 pages.
Goerke et al., "Analysis of the Transfer of Radical Co-polymerisation Systems from Semi-batch to Continuous Plants," in 12th International Symposium on Process Systems Engineering and 25th European Symposium on Computer Aided Process Engineering, Elsevier B.V, Copenhagen, Denmark, 2015, 6 pages.
Gordon-Grossman et al., "W-Band pulse EPR distance measurements in peptides using Gd3+-dipicolinic acid derivatives as spin labels," Physical Chemistry Chemical Physics 13:22 (10771-10780), 2011, 10 pages.
Greenkorn, "Experimental Study of Waterflood Tracers," SPE-169, Society of Petroleum Engineers (SPE), Journal Petroleum Technology, 14(1), Jan. 1962, 6 pages.
Grutzke et al., "Heptacoordinate Heteroleptic Salan (ONNO) and Thiosalan (OSSO) Titanium(IV) Complexes: Investigation of Stability and Cytotoxicity," American Chemical Society (ACS Publications), Inorganic Chemistry 54:14 (6697-6706), Jul. 2015, 10 pages.
Guo et al., "Crystallization in a Mixture of Solvents by Using a Crystal Modifier: Morphology Control in the Synthesis of Highly Monodisperse CaCO3 Microspheres," Angew. Chem. Int. Ed. 2006, 45:3977-3981, 5 pages.
Hagoot, "The response of interwell tracer tests in watered-out reservoirs," SPE 11131-MS, Society of Petroleum Engineers (SPE), presented at the 57th Annual Fall Technical Conference and Exhibition of the Society of Petroleum Engineers of AIME, Sep. 1982, 21 pages.
Han et al., "Application of Silver-Coated Magnetic Microspheres to a SERS-Based Optofluidic Sensor," American Chemical Society (ACS Publications), The Journal of Physical Chemistry (JPCC) 115: 6290-6296, Mar. 7, 2011, 7 pages.
He et al., "Luminescent Europium Chelates Synthesis and Fluorescence Properties," Sensors and Materials 19:2 (123-132), 2007, 10 pages.
He et al., "One-pot Facile Synthesis of Janus Particles with Tailored Shape and Functionality," Electronic Supplementary Material (ESI) for Chemical Communications, The Royal Society of Chemistry, 2011, 17 pages.
Hindle et al., "Dipicolinic acid (DPA) assay revisited and appraised for spore detection," Analyst, 1999, 124: 1599-1604, 6 pages.
Holm et al., "Synthesis, Characterization, and Light-Induced Spatial Charge Separation in Janus Graphene Oxide," American Chemical Society (ACS Publications), Chemistry of Materials (CM) 30: 2084-2092, 2018, 9 pages.

(56) References Cited

OTHER PUBLICATIONS hoteng.com [online], "Microfluidic Solutions for IOR/EOR Optimisation: Rapid and Cost Efficient EOR Screening using a Rock-On-A-Chip Approach," HOT Engineering GmbH, retrieved from URL <https://www.hoteng.com/microfluidic-solutions/#1457967643112-9de392c4-0c28>, retrieved on Jun. 2, 2020, available on or before Mar. 2019, 8 pages.
Hou et al., "Recent advances in colloidal photonic crystal sensors: Materials, structures and analysis methods," Nano Today, 2018, 22, 132-144, 13 pages.
Hu et al., "Fabrication, properties and applications of Janus particles," Chem. Soc. Rev. 41:11 (4356-4378), 2012, Feb. 2012, 23 pages.
Hu et al., "Smart Liquid SERS Substrates based on Fe3O4/Au Nanoparticles with Reversibly Tunable Enhancement Factor for Practical Quantitative Detection," Scientific Report 4: 7204 (1-10), Nov. 2014, 10 pages.
Huseby et al., "Assessing EOR potential from partitioning tracer data," Spe 172808-MS, Society of Petroleum Engineers (SPE), presented at the SPE Middle East Oil and Gas Show and Conference, Mar. 2015, 15 pages.
Huseby et al., "High Quality Flow Information from Tracer Data," SPE-169183-MS, Society of Petroleum Engineers (SPE), presented at the SPE Bergen One Day Seminar, Apr. 2, 2014, 9 pages.
Hutchins et al., "Aqueous Tracers for Oilfield Applications," SPE-21049, Society of Petroleum Engineers (SPE), presented at SPE International Symposium on Oilfield Chemistry, Feb. 20-22, 1991, 9 pages.
Jangda et al., "Evaluation of Fluorosurfactant Performance with Super-Critical CO2 Flooding for High Salinity Carbonate Reservoirs," SPE-169725-MS, presented at the SPE EOR Conference at Oil and Gas West Asia, Society of Petroleum Engineers, Mar. 2014, 14 pages.
Jenkins et al., "Ultratrace Determination of Selected Lanthanides by Luminescence Enhancement," Analytical Chemistry 68:17 (2974-2980), Sep. 1, 1996, 7 pages.
Jun et al., "Multifunctional Silver-Embedded Magnetic Nanoparticles as SERS Nanoprobes and Their Applications," Wiley-VCH Verlag GmbH& Co. KGaA, Weinheim, Small 6:1 (119-125), Jan. 4, 2010, 7 pages.
Junkers, "Precision Polymer Design in Microstructured Flow Reactors: Improved Control and First Upscale at Once," Macromol. Chem. Phys. 218: 1600421-1600421, 2016, 9 pages.
Kaushik et al., "Gd(III) and Mn(II) complexes for dynamic nuclear polarization: small molecular chelate polarizing agents and applications with site-directed spin labeling of proteins," The Royal Society of Chemistry, Physical Chemistry Chemical Physics (PCCP) 18:39 (27205-27218), 2016, 36 pages.
Khan et al., "Optimizing waterflood management in a giant UAE carbonate oil field using simulation-based streamlines," SPE 171777-MS, Society of Petroleum Engineers (SPE), presented at the Abu Dhabi International Petroleum Exhibition and Conference, Nov. 10-13, 2014, 9 pages.
Kneipp et al., "Single Molecule Detection Using Surface-Enhanced Raman Scattering (SERS)," Physical Review Letters, American Physical Society 78:9, Mar. 3, 1997, 4 pages.
Knowles et al., "Zwitterion Functionalized Silica Nanoparticle Coatings: The Effect of Particle Size on Protein, Bacteria, and Fungal Spore Adhesion," Langmuir, 35(5): 1335-1345, 2019, 11 pages.
Kong et al., "Microfluidic diatomite analytical devices for illicit drug sensing with ppb-level sensitivity," Sensors and Actuators, B, 259, 2018, 9 pages.
Kornberger and Thiele, "Experiences with an Efficient Rate-Management Approach for the 8th Tortonian Reservoir in the Vienna Basin," SPE 166393-PA, Society of Petroleum Engineers (SPE), presented at the SPE Annual Technical Conference and Exhibition, Sep. 30-Oct. 2, 2013, SPE Reservoir Evaluation and Engineering 17:2, May 2014, 12 pages.
Kosynkin and Alaskar, "Oil Industry First Interwell Trial of Reservoir Nanoagent Tracers," SPE 181551-MS, Society of Petroleum Engineers (SPE), presented at the SPE Annual Technical Conference and Exhibition, Sep. 2016, 15 pages.
Kramer, "Water-Soluble Dendritic Architectures with Carbohydrate Shells for the Templation and Stabilization of Catalytically Active Metal Nanoparticles," published by ACS, Macromolecules, 38:20 (8308-8315), Aug. 27, 2005, 8 pages.
Kulawardana et al., "Rheology and Transport of Improved EOR Polymers under Harsh Reservoir Conditions," SPE 154294, Society of Petroleum Engineers (SPE), presented at the SPE Improved Oil Recovery Symposium, Apr. 14-18, 2012, 14 pages.
Labbe et al., "Development of metal-chelating inhibitors for the Class II fructose 1,6-bisphosphate (FBP) aldolase," Journal of Inorganic Biochemistry 112: 49-58, Jul. 2012, 10 pages.
Larsen et al., "Efficient Synthesis of 4,7-Diamino Substituted 1,10-Phenanthroline-2, 9-dicarboxamides," Organic Letters, 13:13 (3546-3548), Jul. 1, 2011, 3 pages.
Lee et al., "Site-Selective In Situ Grown Calcium Carbonate Micromodels with Tunable Geometry, Porosity, and Wettability," Advanced Functional Materials Interfaces, 2016, 10 pages.
Levitt et al., "Selection and Screening of Polymers for Enhanced-Oil Recovery," SPE 113845, Society of Petroleum Engineers (SPE), presented at the SPE Symposium on Improved Oil Recovery, Apr. 19-23, 2008, 18 pages.
Lewan, "Evaluation of petroleum generation by hydrous pyrolysis experimentation," Phil. Trans. R. Soc. Lond. A, 1985, 315: 123-134, 13 pages.
Lewan, "Experiments on the role of water in petroleum formation," Geochimica et Cosmochimica Acta, Pergamon, 1997, 61:17 (3691-3723), 33 pages.
Li et al., "Magic Angle Spinning NMR Structure Determination of Proteins from Pseudocontact Shifts," JACS Communications, Journal of the American Chemical Society 135:22 (8294-8303), May 2013, 10 pages.
Li et al., "Thiol-ene reaction: a versatile tool in site-specific labelling of proteins with chemically inert tags for paramagnetic NMR," The Royal Society of Chemistry, Chemical Communications, Cambridge, United Kingdom 48:21 (2704-2706), 2012, 18 pages.
Lomstein and Jorgensen, "Pre-column liquid chromatographic determination of dipicolinic acid from bacterial endospores," Limnology and Oceanography: Methods, Apr. 2012, 10:4, 227-233, 14 pages.
Lu et al., "Quantitative prediction of seismic rock physics of hybrid tight oil reservoirs of the Permian Lucaogou Formation, Junggar Basin, Northwest China," Journal of Asian Earth Sciences, 2019, 178: 216-223, 8 pages.
Luo et al., "Nanofluid of graphene-based amphiphilic Janus Nanosheets for tertiary or enhanced oil recovery: high performance at low concentration," Proceedings of the National Academy of Sciences of USA, PNAS, vol. 113, No. 28, Jul. 12, 2016, 17 pages.
Luo et al., "Secondary Oil Recovery Using Graphene-Based Amphiphilic Janus Nanosheet Fluid at an Ultralow Concentration," American Chemical Society (ACS Publications), Industrial & Engineering Chemistry Research (I&EC Research), 56: 11125-11132, Sep. 2017, 25 pages.
Manna et al., "Complexation behavior of trivalent actinides and lanthanides with 1,10-phenanthroline-2,9-dicarboxylic acid based ligands: insight from density functional theory," Physical Chemistry Chemical Physics (PCCP) 14:31 (11060), Jan. 1, 2012, 10 pages.
Mao et al., "Chemical and nanometer-scale structure of kerogen and its change during thermal maturation investigated by advanced solid-state 13C NMR spectroscopy," Geochimica et Cosmochimica Acta, 2010, 74(7): 2110-2127, 18 pages.
Marais et al., "Time-Resolved Fluorescence for Real-Time Monitoring of Both Scale and Corrosion Inhibitors: a Game-Changing Technique," SPE 179867, Society of Petroleum Engineers (SPE), presented at the SPE International Oilfield Scale Conference and Exhibition held in Aberdeen, Scotland, May 11-12, 2016 11 pages.
Marchetti et al., "Fluorous affinity chromatography for enrichment and determination of perfluoroalkyl substances," American Chemical Society (ACS Publications), Annual Review of Analytical Chemistry 84: 7138-7145, Jul. 19, 2012, 8 pages.

(56) References Cited

OTHER PUBLICATIONS

Martinez et al., "Chapter 9: Polysaccharide-based Nanoparticles for Controlled Release Formulations," in The Delivery of Nanoparticles, 185-222, May 2012, 39 pages.
Martini et al., "How to Monitor Scale Inhibitor Squeeze using Simple TRF Tracers," SPE-173768-MS, Society of Petroleum Engineers (SPE), presented at the SPE International Symposium on Oilfield Chemistry held in the Woodlands, Texas, Apr. 13-15, 2015, 8 pages.
McGrail et al., "Selective mono-facial modification of grapheneoxide nanosheets in suspension," The Royal Society of Chemistry, Chem. Commun., 52: 288-291, 2016, 5 pages.
Melton et al., "Complexes of Greatly Enhanced Thermodynamic Stability and Metal Ion Size-Based Selectivity, Formed by the Highly Preorganized Non-Macrocyclic Ligand 1,10-Phenanthroline-2,9-dicarboxylic Acid: A Thermodynamic and Crystallographic Study," Inorganic Chemistry 45:23 (9306-9314), Nov. 1, 2006, 9 pages.
Meyer et al., "Identification of Source Rocks on Wireline Logs by Density/Resistivity and Sonic Transit Time/Resistivity Crossplots," AAPG Bulletin, 1984, 68(2): 121-129, 9 pages.
micronit.com [online], "Enhanced oil recovery," retrieved from URL <https://www.micronit.com/products/enhanced-oil-recovery.html>, retrieved on Mar. 10, 2020, 5 pages.
micronit.com [online], "Lab-on-a-chip and MEMS Solutions," retrieved from URL <https://www.micronit.com/>, retrieved on Jun. 2, 2020, available on or before Mar. 19, 2018 via wayback machine URL <https://web.archive.org/web/20180319182410/https://www.micronit.com/>, 7 pages.
Miller and McQuade, "5 Synthesis of Materials I Flow—Principles and Practice," in De Gruyter et al., Flow Chemistry, 2: 133-160, 2014, Part II, Chapter 5, 28 pages.
Mohamed et al., "Reaction screening in continuous flow reactors," J. Tetrahedron Letters, 57: 3965-3977, 2016, 12 pages.
Morse et al., "Enhanced Reaction Efficiency in Continuous Flow," Isr. J. Chem, 57:218-227, Apr. 2017, 14 pages.
Moyner et al., "The Application of Flow Diagnostics for Reservoir Management," Society of Petroleum Engineers (SPE), SPE Journal, Apr. 2015, 18 pages.
Muller and Seubert, "Ultra trace determination of fluorobenzoic acids in tap and reservoir water using solid-phase extraction and gas chromatography-mass spectrometry," Journal of Chromatography A, 1260: 9-15, Oct. 2012, 7 pages.
Musyanovych et al., "Preparation of Biodegradable Polymer Nanoparticles by Minicmulsion Technique and Their Cell Interactions," Macromolecular Bioscience, 8:2, Feb. 11, 2008, 13 pages.
Namwong et al., "Fabricating Simple Wax Screen-Printing Paper-Based Analytical Devices to Demonstrate the Concept of Limiting Reagent in Acid-Base Reactions," Journal of Chemical Education 95:2, 2018, 5 page.
Negin et al., "Application of nanotechnology for enhancing oil recovery—A review," Ke Ai Advanced Research Evolving Science, Petroleum 2: 324-333, 2016, 10 pages.
Negin et al., "Most common surfactants employed in chemical enhanced oil recovery," Petroleum 3: 197-211, 2017, 32 pages.
Ng et al., "Graphene-based two-dimensional Janus materials," NPG Asia Materials 10:4 (217-237), Apr. 2018, 21 pages.
Nge et al., "Advances in Microfluidic Materials, Functions, Integration, and Applications," Chem. Rev., Apr. 2013, 113:4 (2550-2583), 34 pages.
Nie et al., "Probing Single Molecules and Single Nanoparticles by Surface-Enhanced Raman Scattering," Science 275:5303 (1102-1106), Feb. 21, 1997, 6 pages.
Nikonov et al., "Development of Remote Gas Condensate Fields: Challenges and Solutions," SPE 176660-MS, Society of Petroleum Engineers (SPE), SPE Russian Petroleum Technology Conference, Oct. 26-28, 2015, published Jan. 1, 2015, 21 pages.
Ogden et al., "Complexation of Am(III) and Nd(in) by 1,10-Phenanthroli ne-2,9-Di carboxylic Acid," Journal of Solution Chemistry 42:1 (211-225), 2013, 15 pages.
Ouali et al., "Analysis of Paramagnetic NMR Spectra of Triple-Helical Lanthanide Complexes with 2,6-Dipicolinic Acid Revisited: A New Assignment of Structural Changes and Crystal-Field Effects 25 Years Later," Inorganic Chemistry 41:6 (1436-1445), Feb. 2002, 10 pages.
Pallenberg et al. "Synthesis and Characterization of Some Copper(I) Phenanthroline Complexes," Inorg. Chem., 34: 2833-2840, 1995, 8 pages.
Parker and Williams, "Getting excited about lanthanide complexation chemistry," Journal of the Chemical Society, Dalton Transactions, 18: 3613-3628, 1996, 16 pages.
Parker et al., "Being excited by lanthanide coordination complexes: aqua species, chirality, excited- state chemistry, and exchange dynamics, " Chemical Reviews, 102:6 (1977-2010), May 2002, 34 pages.
PCT International Search Report and Written Opinion in International Appln. No. PCT/US2021/049076, dated Jan. 11, 2022, 16 pages.
Peng et al., "A review of nanomaterials for nanofluid enhanced oil and recovery," The Royal Society of Chemistry, RSC Advances 7: 32246-32254, Jun. 13, 2017, 9 pages.
Petoud et al., "Brilliant SM, Eu, Tb, and Dy Chiral Lanthanide Complexes with Strong Circularly Polarized Luminescence," JACS Communications, Journal of the American Chemical Society 2017:129 (77-83), Dec. 15, 2006, 7 pages.
Potapov et al., "Nanometer-Scale Distance Measurements in Proteins Using Gd3+ Spin Labeling," Journal of the American Chemical Society, 132:26 (9040-9048), Jun. 2010, 9 pages.
Qianming et al., "Bspda Synthesis and its Europium (III) Complexes' Fluorescence," Chemical Industry Times, Jul. 2005, 19(7): 38-41, 4 pages (English Abstract).
Quadri et al., "Screening of Polymers for EOR in High Temperature, High Salinity and Carbonate Reservoir Conditions," IPTC-18436-MS, presented at the International Petroleum Technology Conference (IPTC), Dec. 6-9, 2015, 30 pages.
Rashadan et al., "Effect of the preparation route, PEG and annealing on the phase stability of Fe3O4 nanoparticles and their magnetic properties," Journal of Experimental Nanoscience 8:2 (210-222), 2013, 14 pages.
Reese et al., "Synthesis of Highly Charged, Monodisperse Polystyrene Colloidal Particles for the Fabrication of Photonic Crystals," Colloid and Interface Science, 2000, 232: 76-80, 5 pages.
Reisch and Klymchenko, "Fluorescent Polymer Nanoparticles Based on Dyes: Seeking Brighter Tools for Bioimaging." Small 12(15): 1968-1992 2016, 25 pages.
Renault et al., "Three-Dimensional Wax Patterning of Paper Fluidic Devices," Langmuir, 30:23, 2014, 7 pages.
Rowan et al., "Dynamic Covalent Chemistry," Angewante Chemie International Edition 41: 898-952, Mar. 15, 2002, 55 pages.
Sabbatini et al., "Luminescent lanthanide complexes as photochemical supramolecular devices," Coordination Chemistry Reviews, 123:1-2 (201-228), Feb. 1993, 28 pages.
Sabhapondit et al., "Water Soluble Acrylamidomethyl Propane Sulfonate (AMPS) Copolymer as an Enhanced Oil Recovery Chemical," Energy & Fuels, 17:683-688, 2003, 6 pages.
Saeki et al., "Upper and lower critical solution temperatures in poly (ethylene glycol) solutions," Polymer, 17:8, (685-689), Aug. 1976, 5 pages.
Sajjadi, "Nanoparticles Formation by Monomer-Starved Semibatch Emulsion Polymerization," Langmuir, 23: 1018-1024, 2007, 7 pages.
Sajjadi, "Particle Formation under Monomer-Starved Conditions in the Semibatch Emulsion Polymerization of Styrene. I. Experimental.," Journal of Polymer Science: Part A: Polymer Chemistry, 39: 3940-3952, 2001, 13 pages.
Sammes and Yshioglu, "Modern bioassays using metal chelates as luminescent probes," Natural Product Reports, 31:1, 1996, 28 pages.
Sanni et al., "A field case study of inter-well chemical tracer test," SPE-173760-MS, Society of Petroleum Engineers (SPE), in SPE International Symposium on Oilfield Chemistry, Apr. 2015, 17 pages.

(56) References Cited

OTHER PUBLICATIONS

Sanni et al., "Pushing the envelope of residual oil measurement: A field case study of a new class of inter-well chemical tracers," Journal of Petroleum Science and Engineering 163, 2018, 19 pages.
Santarelli et al., "Formation Evaluation From Logging on Cuttings," SPE 36851, Society of Petroleum Engineers (SPE), presented at the 1996 SPE Permian Basin Oil and Gas Recovery Conference, Mar. 27-29, 1996, SPE Reservoir Evaluation and Engineering, published Jun. 1998, 7 pages.
Schmidt et al., "Copper dipicolinates as peptidomimetic ligands for the Src SH2 domain," Bioorganic & Medicinal Chemistry Letters, 14:16 (4203-4206), Aug. 2004, 4 pages.
Schmidt et al., "Synthesis of Mono- and Dinuclear Vanadium Complexes and Their Reactivity toward Dehydroperoxidation of Alkyl Hydroperoxides," Inorganic Chemistry 56:3 (1319-1332), 2017, 14 pages.
Seah et al., "Optimizing Recovery in Gas Condensate Reservoirs," SPE 171519-MS, Society of Petroleum Engineers (SPE), SPE Asia Pacific Oil and Gas Conference and Exhibition, Oct. 16, 2014, 19 pages.
Selvin et al., "Principles and biophysical applications of lanthanide-based probes," Annual Review of Biophysics and Biomolecular Structure 31: 275-302, Jun. 2002, 28 pages.
Serres-Piole et al., "Direct sensitive simultaneous determination of fluorinated benzoic acids in oil reservoir waters by ultra high-performance liquid chromatography-tandem mass spectrometry," Journal of Chromatography A, 1218, Aug. 2011, 6 pages.
Serres-Piole et al., "Water tracers in oilfield applications: Guidelines," Elsevier Ltd., Journal of Science and Engineering 98-99: 22-39, Nov. 2012, 18 pages.
ShamsiJazeyi et al., "Polymer-Coated Nanoparticles for Enhance Oil Recovery," Journal of Applied Polymer Science, 131:15, Aug. 5, 2014, 13 pages.
Sharma and Mohanty, "Wettability Alteration in High-temperature and High-salinity Carbonate Reservoirs," SPE 147306, Society of Petroleum Engineers (SPE), presented at the SPE Annual Technical Conference and Exhibition, Oct. 30-Nov. 2, 2011, SPE Journal 18:4 (646-655), Aug. 2013, 10 pages.
Shook et al., "Determining Reservoir Properties and Flood Performance from Tracer Test Analysis," SPE 124614, Society of Petroleum Engineers (SPE), presented at SPE Annual Technical Conference and Exhibition, Oct. 4-7, 2009, 19 pages.
sigmaaldrich.com [online] "pk20 Envicarb/LC-NH2/Si SPE Tubes 20m," Millapore Sigma, available on or before 2021, retrieved on Nov. 17, 2021, retrieved from URL <https://www.sigmaaldrich.com/US/en/product/supelco/54036u?context-product>, 4 pages.
sigmaaldrich.com [online] "Supelclean™ ENVI-Carb/NH2 SPE Tube," Millipore Sigma, available on or before 2021, retrieved on Nov. 17, 2021, retrieved from URL <https://www.sigmaaldrich.com/US/en/substance/supelcleanenvicarbnh2spetube1234598765?context=product>, 2 pages.
sigmaaldrich.com [online] "Supelclean™ SPE Method Development Kit," Millipore Sigma, available on or before 2021, retrieved on Nov. 17, 2021, retrieved from URL <https://www.sigmaaldrich.com/US/en/product/supelco/57074u?context=product>, 4 pages.
Singh et al., "Paper-based sensors: emerging themes and applications," Sensors, 18:9, 2018, 22 pages.
Sobeih et al., "Recent trends and developments in pyrolysis-gas chromatography," Journal of Chromatography A, 1186: 1-2 (51-66), Oct. 11, 2007, 16 pages.
Solomon et al., "Synthesis and Study of Silver Nanoparticles," Journal of Chemical Education 84:2 (332-325), 2007, 4 pages.
Song et al., "SERS-Encoded Nanogapped Plasmonic Nanoparticles: Growth of Metallic Nanoshell by Templating Redox-Active Polymer Brushes," JACS Communications, Journal of the American Chemical Society 136: 6838-6841, Apr. 28, 2014, 4 pages.
Sriram et al., "Paper-based microfluidic analytical devices for coloimetric detection of toxic ions," Trends in Analytical Chemistry, 93, Jun. 2017, 43 pages.
Stein et al., "Design and functionality of colloidal-crystal-templated materials-chemical applications of inverse opals, " Chem. Soc. Rev., 2013, 42: 2763-2803, 41 pages.
Stiles et al., "Surface-Enhanced Raman Spectroscopy," Annual Review of Analytical Chemistry 1: 601-626, Mar. 18, 2008, 29 pages.
Stryer et al., "Diffusion-enhanced fluorescence energy transfer," Annual Review of Biophysics and bioengineering 11:1, 1982, 21 pages.
Su et al., "A Dipicolinic Acid Tag for Rigid Lanthanide Tagging of Proteins and Paramagnetic NMR Spectroscopy," Journal of the American Chemical Society, 130:32 (10486-10487), Jul. 2008, 2 pages.
Tang et al., "Synthesis and fluorescence properties of Tb(III) complexes with pyridine-2,6-dicarboxylic acid derivatives," Journal of Central South University of Technology (English Edition) 15:5 (599-605), Oct. 2008, 7 pages.
Tang et al., "Synthesis of Novel Derivatives of Pyridine-2,6-dicarboxylic Acid," Synthetic Communications: An International Journal for Rapid Communication of Synthetic Organic Chemistry 36:14 (2027-2034), Jun. 2006, 9 pages.
Tang et al., "Synthesis of Eu(III) and Tb(III) Complexes with Novel Pyridine-2,6-Dicarboxylic Acid Derivatives and Their Fluorescence Properties," Front. Chem. China 4: 408-413, 2006, 6 pages.
Tathed et al., "Hydrocarbon saturation in Bakken Petroleum System based on joint inversion of resistivity and dielectric dispersion logs," Fuel, Dec. 2018, 233: 45-55, 11 pages.
Taylor et al., "Water-Soluble Hydrophobically Associating Polymers for Improved Oil Recovery: A Literature Review," SPE 29008, Society of Petroleum Engineers (SPE), Journal of Petroleum Science and Engineering, 19:3-4 (265-280), Mar. 1998, 16 pages.
Thomas et al., "Deployment and Detection of a Novel Barcoded Advanced Tracers System for the Optimization of Improved Waterflood Recovery in Hydrocarbon Reservoirs" SPE-194872-MS, SPE Middle East Oil and Gas Show and Conference. Society of Petroleum Engineers, 2019, 10 pages.
Tian et al., "Off-Resonant Gold Superstructures as Ultrabright Minimally Invasive Surface-Enhanced Raman Scattering (SERS) Probes," American Chemical Society (ACS Publications), Chemistry of Materials (CM) 27: 5678-5684, Jul. 2015, 7 pages.
Toulhoat, "Experimentation and Modelling of U, Th and Lanthanides Transport in Fissured Rocks: Influence of Complexation," MRS Proceedings 50, Jan. 1, 1985, 8 pages.
Trippetta et al., "The seismic signature of heavy oil on carbonate reservoir through laboratory experiments and AVA modelling," Journal of Petroleum Science and Engineering, 2019, 177: 849-860, 12 pages.
Vaccaro et al., "Flow Approaches Towards Sustainability," Green Chem, 16:3680-3704, 2014, 25 pages.
Vatanparast et al., "Wettability alteration of low-permeable carbonate reservoir rocks in presence of mixed ionic surfactants," Petroleum Science and Technology 29:18 (1873-1884), 2011, 14 pages.
Vermolen et al., "Pushing the Envelope for Polymer Flooding Towards High-temperature and High-salinity Reservoirs with Polyacrylamide Based Terpolymers," SPE 141497, Society of Petroleum Engineers (SPE), presented at SPE Middle East Oil and Gas Show and Conference, Mar. 20-23, 2011, 9 pages.
Vollrath et al., "Fluorescence imaging of cancer tissue based on metal-free polymeric nanoparticles—a review." J. Mater. Chem. B 1:15 (1994-2007), 2013, 15 pages.
Wagner, "The Use of Tracers in Diagnosing Interwell Reservoir Heterogeneities—Field Results," SPE-6046, Society of Petroleum Engineers (SPE), Journal of Petroleum Technology, Nov. 1997, 7 pages.
Walther et al., "Janus Particles: Synthesis, Self-Assembly, Physical Properties and Applications," American Chemical Society (ACS Publications), Chem. Rev. 113:7 (5194-5261), Apr. 2013, 68 pages.
Wampler, "Chapter 1: Applied pyrolysis: an overview," Applied Pyrolysis Handbook, 2007, 26 pages.
Wang et al., "The Design and Implementation of a Full Field Inter-Well Tracer Program on a Giant UAE Carbonate Oil Field,"

(56) References Cited

OTHER PUBLICATIONS

SPE-177527-MS, Society of Petroleum Engineers (SPE), in Abu Dhabi International Petroleum Exhibition and Conference, Nov. 2015, 8 pages.
Wang et al., "Toward Reservoir on a Chip: Fabricating Reservoir Micromodels by in Situ Growing Calcium Carbonate Nanocrystals in Microfluidic Channels," ACS Applied Materials and Interfaces, 2017, 21 pages.
Wever et al., "Polymers for enhanced oil recovery: A paradigm for structure-property relationship in aqueous solution, " Progress in Polymer Science, 36:11 (1558-1628), Nov. 2011, 71 pages.
Wu et al., "Development of New Polymers with Better Performance under Conditions of High Temperature and High Salinity," SPE 155653, Society of Petroleum Engineers (SPE), presented at the SPE EOR Conference at Oil and Gas, Apr. 16-18, 2012, 11 pages.
Wu et al., "A reusable biosensor chip for SERS-fluorescence dual mode immunoassay," Proc. SPIE 9543: 954317-1, presented at the Third International Symposium on Laser Interaction with Matter (LIMIS), May 4, 2015, 6 pages.
Wu et al., "A SERS-Assisted 3D Barcode Chip for High-Throughput Biosensing," Material Views Full Papers, Small Journal 11:23 (2798-2806), Jun. 11, 2015, 9 pages.
Xu et al., "Measurement of two-photon excitation cross sections of molecular fluorophores with data from 690 to 1050 nm," Journal of the Optical Society of America B 13:3, Mar. 1996, 11 pages.
Yang et al., "The Co-Luminescence Groups of Sm-La-pyridyl Carboxylic Acids and the Binding Characteristics between the Selected Doped Complex and Bovine Serum Albumin," Bulletin of the Korean Chemical Society 33:4 (1303-1309), Apr. 20, 2012, 7 pages.
Yang et al., "Paramagnetic labeling of proteins and pseudocontact shift in structural biology," Chinese Journal of Magnetic Resonance, 2014, 31:2 (155-171), English Abstract.
Ye et al., "Synthesis and Characterization of a Water-Soluble Sulfonates Copolymer of Acrylamide and N-Allylbenzamide as Enhanced Oil Recovery Chemical," Journal of Applied Polymer Science, 128:3, (2003-2011), May 5, 2013, 9 pages.
Yun et al., "Toward Reservoir on a Chip: Rapid Performance Evaluation of Enhanced Oil Recovery Surfactants for Carbonate Reservoirs Using a Calcite-Coated Micromodel," Nature Scientific Reports, 2020, 12 pages.
Zamberi et al., "Improved Reservoir Surveillance Through Injected Tracers In A Saudi Arabian Field: Case Study," SPE 166005, Society of Petroleum Engineers (SPE), presented at the SPE Reservoir Characterization and Simulation Conference and Exhibition, Sep. 16-18, 2013, 15 pages.
Zemel, "Chapter 3: Tracers in the Oil Field," in Tracers in the Oil Field, Technology and Engineering, Elsevier 43, Jan. 1995, 47 pages.
Zhang and Liu, "Mixed-mode chromatography in pharmaceutical and biopharmaceutical applications," Journal of Pharmaceutical and Biomedical Analysis, 2016,128: 73-88, 16 pages.
Zhang et al., "Effect of Concentration on HPAM Retention in Porous Media," SPE-166265-PA, Society of Petroleum Engineers (SPE), presented as SPE Annual Technical Conference and Exhibition, 373-380, Sep. 30-Oct. 2, 2013, 11 pages.
Zhang et al., "Janus Particles: Synthesis, Self-Assembly, Physical Properties, and Applications," American Chemical Society (ACS Publications), Langmuir 33: 6964-6977, 2017, 14 pages.
Zhang et al., "Novel zwitterionic surfactant derived from castor oil and its performance evaluation for oil recovery," Colloids Surfaces A: Physicochemical and Engineering Aspects 483: 87-95, 2015, 42 pages.
Zhang et al., "Geomaterial-Functionalized Microfluidic Devices Using a Universal Surface Modification Approach," Advanced Material Interfaces, 2019, 6:23, 16 pages.
Zhao et al., "Chromatographic Separation of Highly Soluble Diamond Nanoparticles Prepared by Polyglycerol Grafting," Angewandte Chemie International Edition, 50:6 (1388-1392), Feb. 7, 2011, 5 pages.
Zhou et al., "Upconversion luminescent materials: advances and applications," American Chemical Society (ACS Publications), Chemical Reviews, 115: 395-465, Jan. 14, 2015, 71 pages.

* cited by examiner

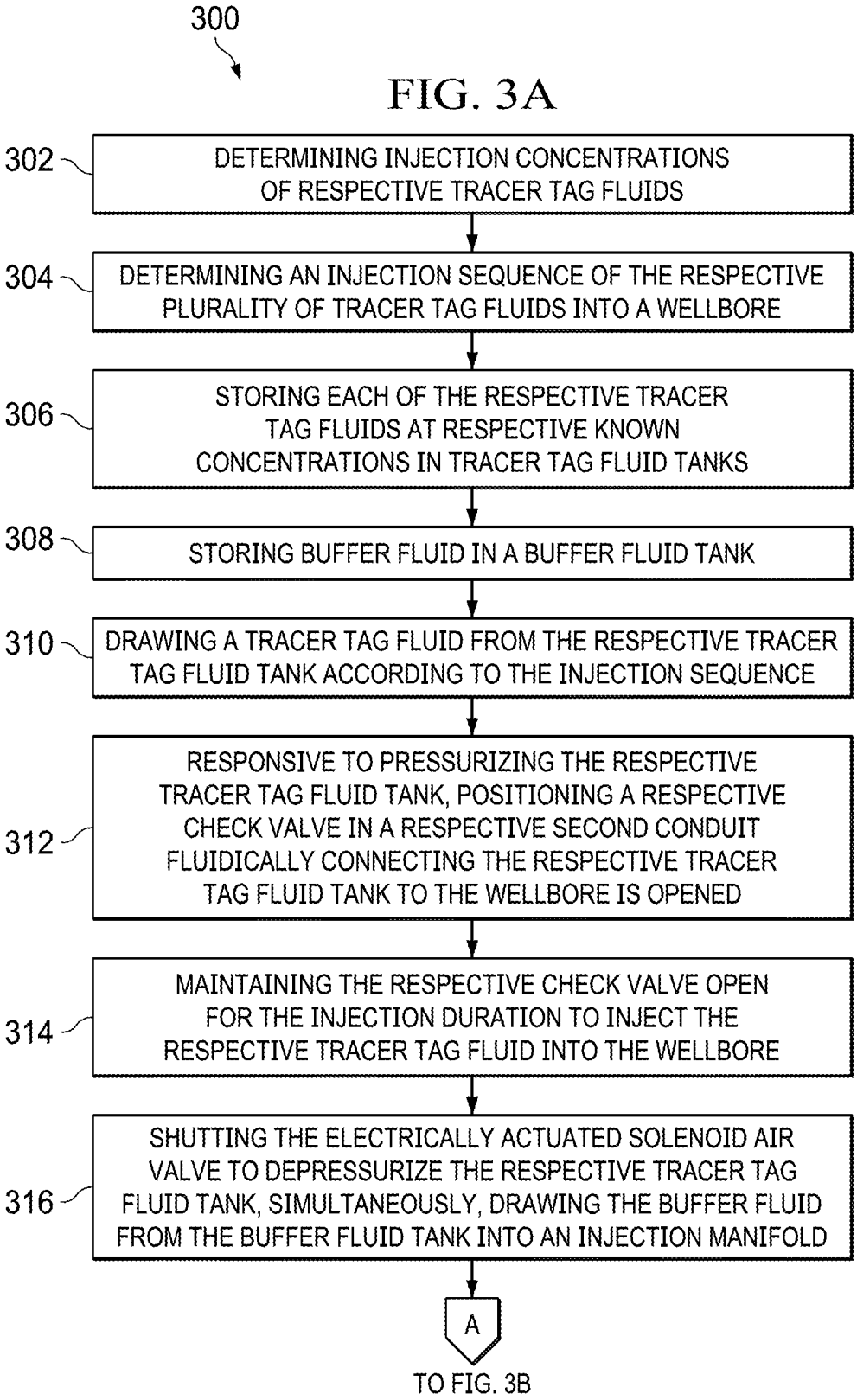
300
FIG. 3A
302
DETERMINING INJECTION CONCENTRATIONS OF RESPECTIVE TRACER TAG FLUIDS
304
DETERMINING AN INJECTION SEQUENCE OF THE RESPECTIVE PLURALITY OF TRACER TAG FLUIDS INTO A WELLBORE
306
STORING EACH OF THE RESPECTIVE TRACER TAG FLUIDS AT RESPECTIVE KNOWN CONCENTRATIONS IN TRACER TAG FLUID TANKS
308
STORING BUFFER FLUID IN A BUFFER FLUID TANK
310
DRAWING A TRACER TAG FLUID FROM THE RESPECTIVE TRACER TAG FLUID TANK ACCORDING TO THE INJECTION SEQUENCE
312
RESPONSIVE TO PRESSURIZING THE RESPECTIVE TRACER TAG FLUID TANK, POSITIONING A RESPECTIVE CHECK VALVE IN A RESPECTIVE SECOND CONDUIT FLUIDICALLY CONNECTING THE RESPECTIVE TRACER TAG FLUID TANK TO THE WELLBORE IS OPENED
314
MAINTAINING THE RESPECTIVE CHECK VALVE OPEN FOR THE INJECTION DURATION TO INJECT THE RESPECTIVE TRACER TAG FLUID INTO THE WELLBORE
316
SHUTTING THE ELECTRICALLY ACTUATED SOLENOID AIR VALVE TO DEPRESSURIZE THE RESPECTIVE TRACER TAG FLUID TANK, SIMULTANEOUSLY, DRAWING THE BUFFER FLUID FROM THE BUFFER FLUID TANK INTO AN INJECTION MANIFOLD
A
TO FIG. 3B

INJECTING MULTIPLE TRACER TAG FLUIDS INTO A WELLBORE

CROSS-REFERENCE TO RELATED PATENT APPLICATIONS

This application is a divisional of U.S. Pat. No. 11,773,715, filed Sep. 3, 2021, published as U.S. Patent Application Publication No. 2022/0065101, which claims priority to, and the benefit of, U.S. Provisional Application No. 63/074,287 filed on Sep. 3, 2020, the contents of which are incorporated by reference herein.

TECHNICAL FIELD

This disclosure relates tracking fluids that flow through a wellbore.

BACKGROUND OF THE DISCLOSURE

A drilling assembly is the physical hardware and equipment used to remove portions of rock from the Earth to create a wellbore. The wellbore is created to extract naturally occurring oil and gas deposits from the Earth and move the oil and gas to the surface of the Earth through the wellbore after the wellbore has been drilled in the Earth by the drilling assembly. The portions of rock are wellbore cuttings. The wellbore cuttings are generated by a drill bit attached to the drilling assembly. A drilling mud is pumped down through the drilling assembly and exits the drilling assembly at the drill bit. The drilling mud carries the wellbore cuttings from the drill bit up the wellbore annulus created by the wellbore surface and an outer surface of the drilling assembly to the surface of the Earth. Wellbore cuttings generated at a first depth of the wellbore can mix from wellbore cuttings generated at a second depth of the wellbore as the wellbore cuttings travel up the wellbore annulus to the surface of the Earth. Wellbore cuttings can be collected and analyzed. The process of analyzing wellbore cuttings is called mud logging. When wellbore cuttings generated at different depths mix, the veracity and depth accuracy of the mud logging analysis is degraded. This decreases the usefulness of the mud logging analysis.

SUMMARY

This disclosure describes technologies related to injecting multiple tracer tag fluids into a wellbore. Implementations of the present disclosure include a method for injecting multiple tracer tag fluids into a wellbore. The method for injecting multiple tracer tag fluids into the wellbore includes determining multiple injection concentrations of multiple respective tracer tag fluids, determining an injection sequence of the multiple respective tracer tag fluids into a wellbore, and injecting the multiple respective tracer tag fluids into the wellbore according to the injection concentrations and the injection sequence. Each of the multiple respective tracer tag fluids include respective synthesized polymeric nanoparticles suspended in a solution. Each of the respective synthesized polymeric nanoparticles are configured bind to a respective wellbore cutting. Each of the respective synthesized polymeric nanoparticles are configured to undergo a thermal de-polymerization at a respective temperature. The thermal de-polymerization of the respective synthesized polymeric nanoparticles generates a respective mass spectra. The injection sequence includes an injection duration and an injection pause. The injection duration is determined by a depth interval of the wellbore to be tagged by the respective synthesized polymeric nanoparticles. The injection pause prevents mixing the multiple tracer tag fluids in the wellbore.

In some implementations, the method further includes storing each of the tracer tag fluids at the respective known concentrations in respective tracer tag fluid tanks.

In some implementations, the method further includes drawing the each of the tracer tag fluids from the respective tracer tag fluid tanks.

In some implementations, the method further includes storing a buffer fluid in a buffer fluid tank.

In some implementations, the method further includes drawing the buffer fluid from the buffer fluid tank.

In some implementations, injecting the tracer tag fluids into the wellbore according to the injection concentrations and the injection sequence further includes actuating multiple respective valves according to the injection sequence.

In some implementations, actuating the multiple respective valves further includes opening multiple respective electrically actuated solenoid air valves positioned in multiple respective conduits. The respective conduits fluidically connect an air tank to the respective tracer tag fluid tanks. The air tank is configured to pressurize the respective tracer tag fluid tanks when the respective electrically actuated solenoid air valves are opened. Each of the electrically actuated solenoid air valves control a pressure of the air flowing from the air tank to the respective tracer tag fluid tank. The method further includes, responsive to pressurizing the respective tracer tag fluid tanks, opening respective check valves positioned in multiple respective second conduits fluidically connecting the respective tracer tag fluid tanks to the wellbore. The method further includes maintaining the respective check valves open for the injection duration to inject the respective tracer tag fluids into the wellbore. The method further includes shutting the respective electrically actuated solenoid air valves. The respective tracer tag fluid tanks depressurize when the electrically actuated solenoid air valves shut. The method further includes, simultaneously, while shutting the respective electrical actuated solenoid air valves, opening an electrically actuated solenoid air valve positioned in a buffer fluid conduit. The buffer fluid conduit fluidically connects a buffer fluid tank to the wellbore. The air tank is configured to pressurize the buffer fluid tank when the buffer fluid electrically actuated solenoid air valve is opened. The method includes, responsive to depressurizing the respective tracer tag fluid tanks and simultaneously opening the buffer fluid electrically actuated solenoid air valve, shutting the respective check valves. The method includes, responsive to shutting the multiple respective check valves, stopping injection of the respective tracer tag fluids into the wellbore.

In some implementations, actuating the multiple respective valves further includes opening multiple respective electrically actuated solenoid air valves positioned in multiple respective conduits. The respective conduits fluidically connect an air tank to the respective tracer tag fluid tanks. The air tank is configured to pressurize the respective tracer tag fluid tanks when the respective electrically actuated solenoid air valves are opened. The method further includes, responsive to pressurizing the respective tracer tag fluid tanks, opening respective check valves positioned in multiple respective second conduits fluidically connecting the respective tracer tag fluid tanks to the wellbore. The method further includes maintaining the respective check valves open for the injection duration to inject the respective tracer tag fluids into the wellbore. The method further includes throttling, by a throttle valve positioned in an injection manifold fluidically coupling the tracer tag fluid tanks to the wellbore, a flow of the respective plurality of tracer tag fluids from the respective tracer tag fluid tanks through the injection manifold into the wellbore. The method further includes shutting the respective electrically actuated solenoid air valves. The respective tracer tag fluid tanks depressurize when the electrically actuated solenoid air valves shut. The method further includes, simultaneously, while shutting the respective electrical actuated solenoid air valves, opening an electrically actuated solenoid air valve positioned in a buffer fluid conduit. The buffer fluid conduit fluidically connects a buffer fluid tank to the wellbore. The air tank is configured to pressurize the buffer fluid tank when the buffer fluid electrically actuated solenoid air valve is opened. The method includes, responsive to depressurizing the respective tracer tag fluid tanks and simultaneously opening the buffer fluid electrically actuated solenoid air valve, shutting the respective check valves. The method includes, responsive to shutting the multiple respective check valves, stopping injection of the respective tracer tag fluids into the wellbore.

In some implementations, the method can further include mixing the tracer tag fluids with a hydrophilic co-monomer or ionic surfactant configured to make the tracer tag fluids compatible with a water based mud.

In some implementations, the method can further include reverse emulsifying the tracer tag fluids to make the tracer tag fluids compatible with an oil based mud.

In some implementations, the method can further include collecting the synthesized polymeric nanoparticles bound to the respective wellbore cuttings and analyzing synthesized polymeric nanoparticles bound to the wellbore cuttings.

In some implementations, analyzing the synthesized polymeric nanoparticles bound to the wellbore cuttings can further include analyzing the synthesized polymeric nanoparticles bound to the wellbore cuttings with a gas chromatography—mass spectrometry instrument including a pyrolyzer.

Further implementations of the present disclosure include a wellbore cuttings tagging system including a controller, multiple tracer tag fluid tanks, a buffer fluid, an air tank, multiple valves positioned in multiple respective first conduits, and multiple second valves positioned in multiple respective second conduits. The controller is configured to determine the injection concentrations of the tracer tag fluids, determine an injection sequence of the tracer tag fluids into a wellbore, and inject the tracer tag fluids into the wellbore according to the injection concentrations and the injection sequence. Each tracer tag fluid includes synthesized polymeric nanoparticles suspended in a solution. The synthesized polymeric nanoparticles are configured to bind to a wellbore cutting. The synthesized polymeric nanoparticles are configured to undergo a thermal de-polymerization at a temperature. The thermal de-polymerization of the synthesized polymeric nanoparticles generates a unique mass spectra. The injection sequence includes an injection duration determined by a depth interval of the wellbore to be tagged by the synthesized polymeric nanoparticles and an injection pause to prevent mixing the tracer tag fluids in the wellbore. The tracer tag fluid tanks are configured to store each of the tracer tag fluids at a respective known concentrations. The buffer fluid tank is configured to store a buffer fluid. The air tank is configured to store pressurized air. The multiple first valves are positioned in multiple first conduits fluidically connecting the air tank to the respective tracer tag fluid tanks and the buffer fluid tank. The multiple second valves are positioned in the multiple respective second conduits fluidically connecting the respective tracer tag fluid tanks to the wellbore and the buffer fluid tank. The multiple second valves are configured to allow flow from the tracer tag fluid tanks and the buffer fluid tank into the wellbore and stop flow from the wellbore into the tracer tag fluid tanks and the buffer fluid tank.

In some implementations, the multiple first valves are electrically actuated solenoid air valves.

In some implementations, the wellbore cuttings tagging system includes a throttle valve positioned in an injection manifold fluidically coupling the tracer tag fluid tanks to the wellbore. The throttle valve controls a flow of the tracer tag fluids from the respective tracer tag fluid tanks through the injection manifold into the wellbore.

In some implementations, the controller is a non-transitory computer-readable storage medium storing instructions executable by one or more computer processors. The instructions, when executed by the one or more computer processors, cause the one or more computer processors to determine the injection concentrations of multiple tracer tag fluids, to determine an injection sequence of the tracer tag fluids into a wellbore, and to inject the tracer tag fluids into the wellbore according to the injection concentrations and the injection sequence.

Further implementations of the present disclosure include a drilling system including a drilling rig and a wellbore cuttings tagging sub-system. The drilling rig includes a drill assembly, a drilling mud pit, and a mud pump. The drilling rig is configured to drill a wellbore in the Earth and to conduct a drilling mud to a downhole location. The drill assembly is disposed in the wellbore. The drilling mud exits the drilling assembly at a drill mud exit orifice at the bottom of the drilling assembly. The mud pump with a mud pump suction is fluidically coupled to the drilling mud pit and a mud pump discharge is fluidically connected to the drilling assembly. The wellbore cuttings tagging sub-system includes a controller, tracer tag fluid tanks, a buffer fluid tank, an air tank, multiple first valves positioned in multiple first conduits, and multiple second valves positioned in multiple respective second conduits. The controller is configured to determine the injection concentrations of the tracer tag fluids, determine an injection sequence of the tracer tag fluids into a wellbore, and inject the tracer tag fluids into the wellbore according to the injection concentrations and the injection sequence. Each tracer tag fluid includes synthesized polymeric nanoparticles suspended in a solution. The synthesized polymeric nanoparticles are configured to bind to a wellbore cutting. The synthesized polymeric nanoparticles are configured to undergo a thermal de-polymerization at a temperature. The thermal de-polymerization of the synthesized polymeric nanoparticles generates a unique mass spectra. The injection sequence includes an injection duration determined by a depth interval of the wellbore to be tagged by the synthesized polymeric nanoparticles and an injection pause to prevent mixing the tracer tag fluids in the wellbore. The tracer tag fluid tanks are configured to store each of the tracer tag fluids at a respective known concentrations. The buffer fluid tank is configured to store a buffer fluid. The air tank is configured to store pressurized air. The multiple first valves are positioned in multiple first conduits fluidically connecting the air tank to the respective tracer tag fluid tanks and the buffer fluid tank. The multiple second valves are positioned in the multiple respective second conduits fluidically connecting the respective tracer tag fluid tanks to the wellbore and the buffer fluid tank. The multiple second valves are configured to allow flow from the tracer tag fluid tanks and the buffer fluid tank into the wellbore and stop flow from the wellbore into the tracer tag fluid tanks and the buffer fluid tank. The multiple second conduits are fluidically connected to the mud pump suction.

In some implementations, the drilling system further includes mixing tanks fluidically coupled to the tracer tag fluid tanks. The mixing tanks are configured to mix the tracer tag fluids with a hydrophilic co-monomer or an ionic surfactant. Mixing the tracer tag fluids with the hydrophilic co-monomer or ionic surfactant configures the tracer tag fluids to be compatible with a water based mud.

In some implementations, the drilling system further includes a reverse emulsification tank. The reverse emulsification tank is fluidically coupled to the tracer tag fluid tanks. The reverse emulsification tank is configured to reverse emulsify the tracer tag fluids. Reverse emulsifying the tracer tag fluids configures the tracer tag fluids to be compatible with an oil based mud.

In some implementations, the drilling system further includes a gas chromatography—mass spectrometry instrument including a pyrolyzer configured to analyze the synthesized polymeric nanoparticles bound to the respective plurality of wellbore cuttings.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIG. 3A is a flow chart of an example method of operating a wellbore cuttings tagging system.

DETAILED DESCRIPTION OF THE DISCLOSURE

Figure 1A:
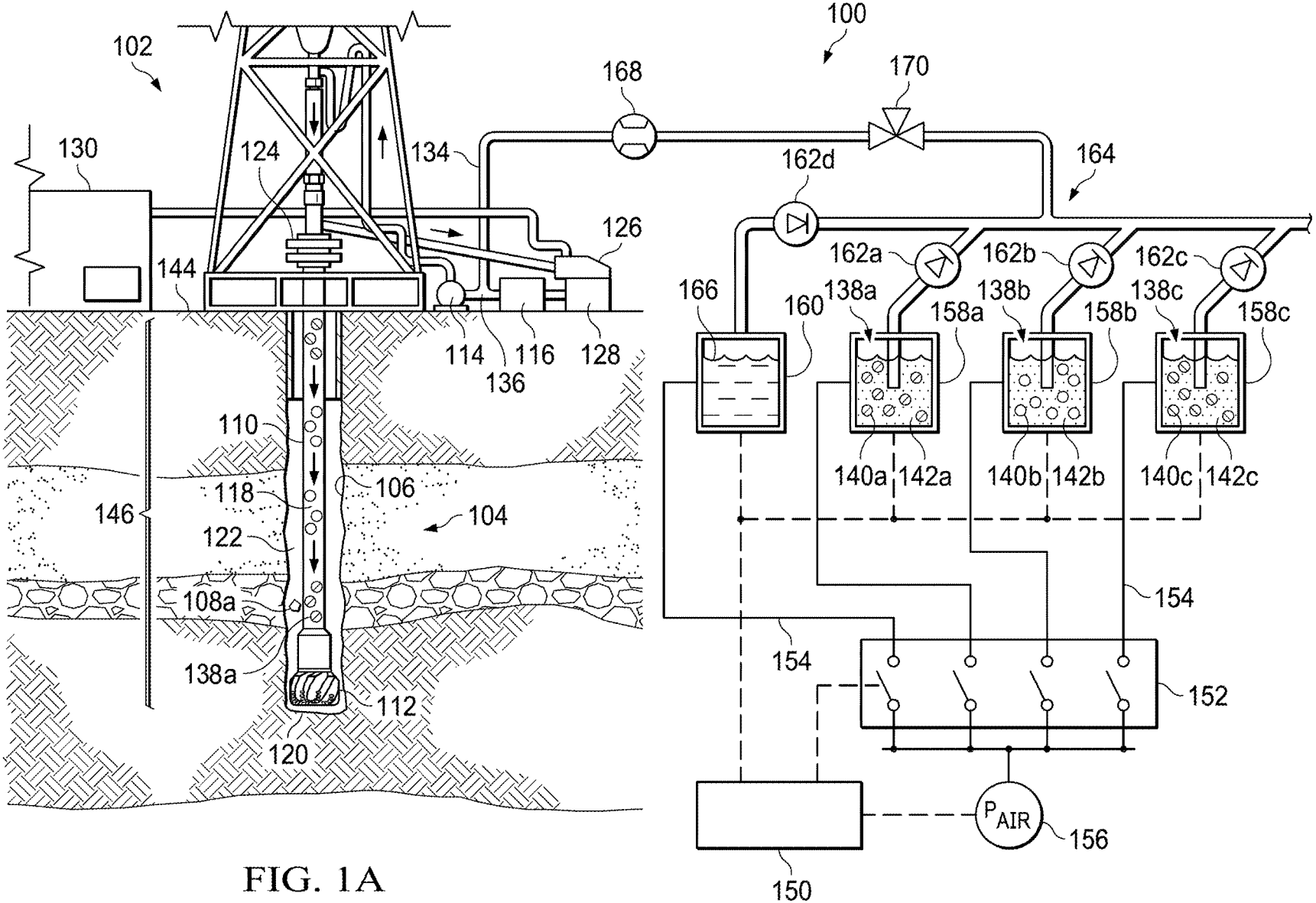
FIG. 1A is a schematic view of a drilling system including a wellbore cuttings tagging system with a drilling assembly at a first depth.

The present disclosure relates to a method of injecting multiple tracer tag fluids at an injection concentration into a wellbore according to an injection sequence. A tracer tag fluid is synthesized polymeric nanoparticles suspended in a solution. The synthesized polymeric nanoparticles bind to a wellbore cutting and are configured to undergo a thermal de-polymerization at a specific temperature. The thermal de-polymerization of the synthesized polymeric nanoparticles generates a specific mass spectra. The injection sequence has an injection duration and an injection pause. The injection duration is determined by a depth interval of the wellbore to be tagged by the respective synthesized polymeric nanoparticles. The concentration of the wellbore cuttings is dependent on the concentration in the mud due to the injected tracer tag fluid. It does not build up over time. The duration of the injection dictates how thick a zone is drilled and tagged or, equivalently, how long is the duration of tagged cuttings arriving on the shale-shakers. The injection pause prevents mixing of two consecutively-injected tracer tag fluids in the wellbore and on the wellbore cuttings. The tracer tag fluids are injected into the wellbore according to the injection concentrations and the predetermined injection sequence. Injecting multiple tracer tag fluids according to the injection sequence (the injection duration and the injection pause) creates a barcoded nanoparticle tagging of the wellbore cuttings over the depth of the wellbore.

Implementations of the present disclosure realize one or more of the following advantages. The quality of direct petro-physical characterization of wellbore cuttings can be improved. For example, mud logging correlation to logging while drilling tools can be improved. Formation analysis where logging while drilling tools are not available or cannot be used is improved. For example, depth correlated formation analysis can become available without longing while drilling tools. Inaccuracies of depth determination from over gauge hole drilling, wellbore drilling mud hydraulic flows, wellbore cleaning operations, and gravitational debris accumulation can be reduced. Additionally, inaccuracies from labelling or sorting practices of the wellbore cuttings can be reduced. For example, logging while drilling tools may not be available in some small wellbore hole diameters. The tagging of the wellbore cutting at the depth at which a specific wellbore cutting is generated decreases the depth uncertainty. Significantly, this barcoded nanoparticle tagging of the cuttings applies a time and depth correction based on the downward traveling drilling mud arrival time, which is much shorter than the upward-traveling drilling mud returns arrival time. Also, the time and depth correction is much better known, as the internal drill pipe and drill string tools' internal dimensions are accurately machined and constant, whereas the wellbore dimensions in the open-hole section are not generally well known at the time of drilling and can depend considerably on the drilling practices and formation integrity.

Other advantages include increased injection control, better timed injection durations and injection pauses, including quicker transition times between injecting and not injecting the tracer tag fluid. For example, a sharp transition between a valve open state for injecting the tracer tag fluids to a valve closed state for stopping the injection of the tracer tag fluids can be achieved. Improved accuracy of quantity of the tracer tag fluid injection can be achieved. The injection cycles can be automated to allow for long duration logging analysis. Waste of costly and difficult to manufacture synthesized polymeric nanoparticles is reduced.

Other advantages include increased personnel safety. For example, the risk of explosion from electrical equipment in proximity to volatile substances off-gassing from the drilling mud is reduced.

As shown in FIG. 1A, a wellbore cuttings tagging system 100 is installed on a drilling rig 102. A drilling assembly 104 is suspended from the drilling rig 102. The drilling assembly 104 removes portions of rock from the Earth to create a wellbore 106. The portions of rock removed from the Earth are wellbore cuttings 108*a*. A drilling assembly 104 can include a drill pipe 110 with a drill bit 112 attached to the bottom of the drilling assembly 104. Additionally, the drilling assembly 104 can include measurement while drilling tools, logging while drilling tools, stabilizers, reamers, motors, and coiled tubing assemblies. The drill bit 112 applies the weight of the drilling assembly 104 and the rotational movement of the drill string 104 to remove the portions of rock to generate the wellbore cuttings 108*a*. Drilling mud is pumped by a mud pump 114 from a mud pit 116 on the surface 144 of the Earth to the drilling assembly 104. The drilling mud travels down the interior 118 of the drilling assembly 104 to the exit the drill bit 112 at the bottom 120 of the wellbore 106. The drilling mud carries the wellbore cutting 108*a* in an uphole direction from the bottom of the wellbore 106 in an annulus 122 defined by the outer surface 124 of the drilling assembly 104 and the wellbore 106. The wellbore cuttings 108*a* exit the annulus 122 at the wellhead 124 and is carried to the shale shaker 126. The shale shaker 126 separates the wellbore cuttings 108*a* from the drilling mud. The drilling mud without the wellbore cuttings 108*a* is returned to the mud pit 116. Wellbore cuttings 108*a* can be disposed in a shale pit 128 or analyzed by mud logging analysis equipment 130.

The mud logging analysis equipment 130 can include a gas chromatography—mass spectrometry instrument including a pyrolyzer. A gas chromatography—mass spectrometry instrument including a pyrolyzer heats up a sample of the wellbore cuttings 108*a* with the synthesized polymeric nanoparticles 140*a-c*. The synthesized polymeric nanoparticles 140*a-c* decompose. The gas chromatography—mass spectrometry instrument detects the different elements, compounds, and quantities contained in the sample. The analysis of the tagged wellbore cuttings 108*a* can occur after a time delay allowing the wellbore cuttings 108*a* to be collected. For example, the time delay can be 0.5 hours to 1 hour. The analysis is time-correlated with the pumping of tracer tag fluids 138*a-c* in a pre-determined sequence, and is proceeding in parallel with injecting subsequent tracer tag fluids 138*a-c*.

The wellbore cutting tagging system 100 discharges multiple tracer tag fluids 138*a-c* through an injection conduit 134 coupled to the mud pump suction 136. Each tracer tag fluid 138*a-c* includes synthesized polymeric nanoparticles 140*a-c* suspended in a solution 142*a-c*, respectively. The synthesized polymeric nanoparticles 140*a-c* are configured to bind to wellbore cuttings 108*a*. The synthesized polymeric nanoparticles 140*a-c* are configured to undergo a thermal de-polymerization at a specific temperature. When the synthesized polymeric nanoparticles 140*a-c* undergo thermal de-polymerization, a unique mass spectra is produced. Each tracer tag fluid 138*a-c* includes different synthesized polymeric nanoparticles 140*a-c*, so different unique mass spectra are produced from different tracer tag fluids 138*a-c*. The first tracer tag fluid 138*a* includes synthesized polymeric nanoparticles 140*a* suspended in a first solution 142*a*. The second tracer tag fluid 138*b* includes synthesized polymeric nanoparticles 140*b* suspended in a second solution 142*b*. The third tracer tag fluid 138*c* includes synthesized polymeric nanoparticles 140*c* suspended in a solution third 142*c*. Fewer or more tracer tag fluids 138*a-c* can be included in the wellbore cutting tagging system 100.

The tracer tag fluid 138*a-c* can be mixed with a hydrophilic co-monomer or ionic surfactant to make the tracer tag fluid 138*a-c* compatible with a water based mud. The tracer tag fluid 138*a-c* may be reverse emulsified to make the tracer tag fluid 138*a-c* compatible with an oil based mud.

The mud pump 114 moves the first tracer tag fluid 138*a* along with the drilling mud through the drilling assembly 104 described above to exit the drill bit 112 at the bottom of 120 of the wellbore 106. Upon exiting the drill bit 112, the synthesized polymeric nanoparticles 140*a* from the first tracer tag fluid 136*a* contact a wellbore cuttings 108*a* while the drill bit 112 is drilling and generating wellbore cuttings 108*a* at a first depth 146 at a first time. The synthesized polymeric nanoparticles 140*a* bind to the wellbore cutting 108*a*. The wellbore cutting 108*a* bound to the synthesized polymeric nanoparticles 140*a* is pumped up the annulus 122 of the wellbore 106 as described earlier.

Figure 1B:
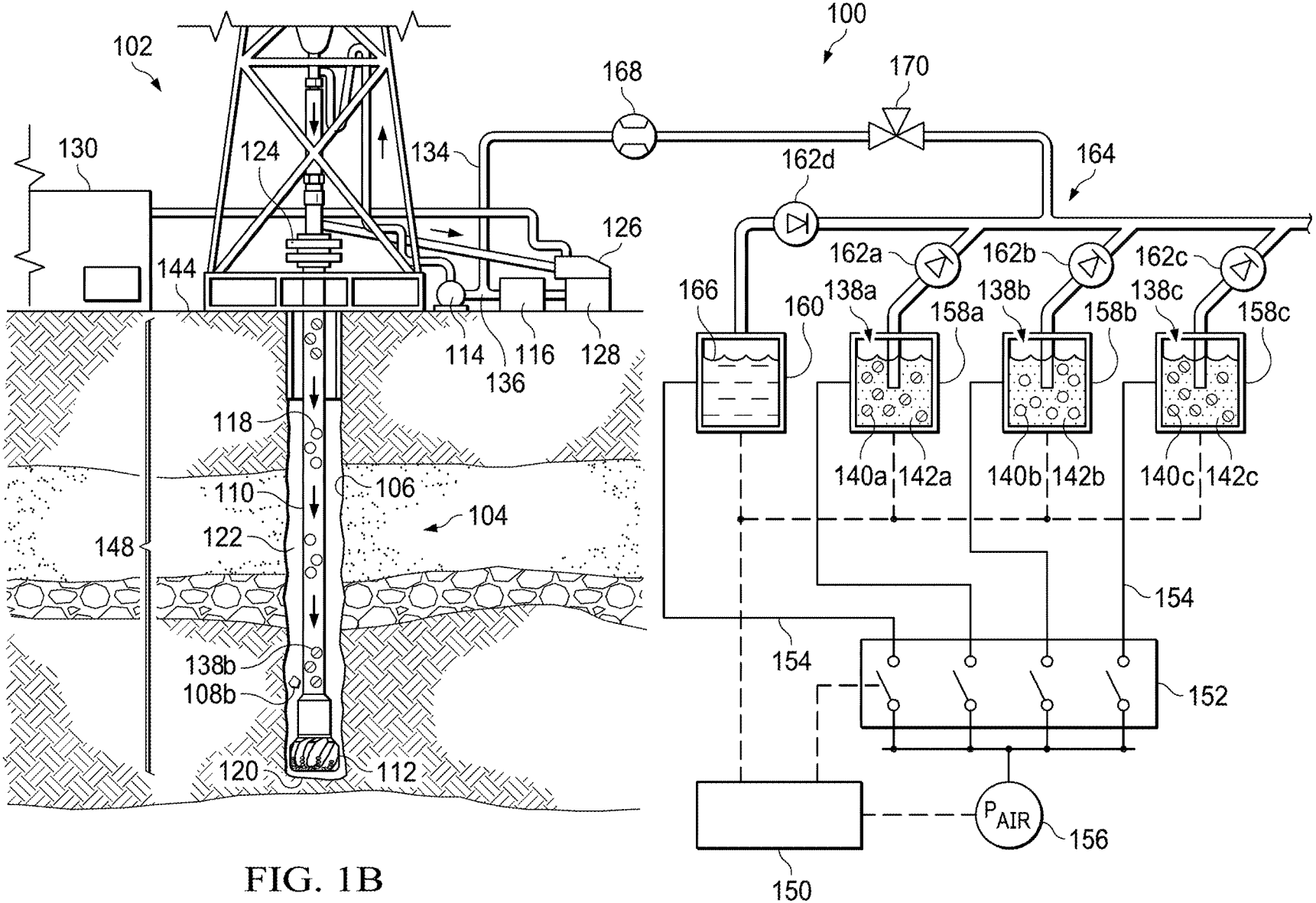
FIG. 1B is a schematic view of the drilling system including the wellbore cuttings tagging system of FIG. 1A with the drilling assembly at a second depth.

The drill bit 112 continues to remove the portions of rock to generate the wellbore cuttings 108*b*. Referring to FIG. 1B, the depth 146 (shown in FIG. 1A) of the wellbore 106 increases to a second depth 148 deeper from the surface 144 of the Earth than the first depth 146 over a period of time. At the second depth, the wellbore cutting tagging system 100 discharges the second tracer tag fluid 138*b* through the injection conduit 134 coupled to the mud pump suction 136. The mud pump 114 moves the second tracer tag fluid 138*b* along with the drilling mud through the drilling assembly 104 described above, to exit the drill bit 112 at the new bottom of 120 of the wellbore 106 at the second depth 148. Upon exiting the drill bit 112, the synthesized polymeric nanoparticles 140*b* from the second tracer tag fluid 138*b* contact a second wellbore cutting 108*b* generated at the second depth 148. The synthesized polymeric nanoparticles 140*b* bind to the second wellbore cutting 108*b*. The wellbore cutting 108*b* bound to the synthesized polymeric nanoparticles 140*b* are pumped up the annulus 122 of the wellbore 106 as described earlier. The drill bit 112 continues to remove the portions of rock to generate the wellbore cuttings 108. The depth of the wellbore 106 increases to a third depth deeper from the surface 144 of the Earth than the first depth 146 and the second depth 148 over a second period of time. At the third depth, the wellbore cutting tagging system 100 discharges the third tracer tag fluid 138*c* and the process continues. The process of drilling to generate wellbore cuttings 108*b* and injecting tracer tag fluids 138*b* continues until drilling the wellbore 106 is completed or the mud logging operations are completed.

Referring to FIGS. 1A and 1B, the wellbore cutting tagging system 100 includes a controller 150. In some implementations, the controller 150 is a non-transitory computer-readable medium storing instructions executable by one or more processors to perform operations described here. In some implementations, the controller 150 includes firmware, software, hardware or combinations of them. The instructions, when executed by the one or more computer processors, cause the one or more computer processors to determine a plurality of injection concentrations of a respective plurality of tracer tag fluid 138*a-c*, determine an injection sequence of the respective tracer tag fluids 138*a-c* into a wellbore 106, and inject the respective tracer tag fluids 138*a-c* into the wellbore according to the injection concentrations and the injection sequence. The controller 150 is configured to determine injection concentrations of the tracer tag fluids 138*a-c*, to determine an injection sequence of the tracer tag fluids 138*a-c* into the wellbore 106, and to control the injection of the tracer tag fluids 138*a-c* into the wellbore 106 according to the injection concentrations and the injection sequence. The controller 150 is configured to receive data inputs from the drilling rig 102. Some inputs from the drilling rig 102 include wellbore 106 design and construction such as physical wellbore 106 dimensions and geologic formation lithology and composition; drilling mud properties such as mud density, viscosity, chemical composition, pH, and dissolved solids content; and drilling parameters such as time, depth, rate of penetration, pump pressures, and pump flow rates.

The controller 150 determines the injection concentrations of the tracer tag fluids 138*a-c* from the data inputs from the drilling rig 102 to determine a minimum detectable concentration of the synthesized polymeric nanoparticles 140*a-c* needed in the wellbore 106 based on the wellbore 106 conditions (i.e. data inputs from the drilling rig 102).

For example, a 5 ppm synthesized polymeric nanoparticles concentration may be necessary as the synthesized polymeric nanoparticles 140*a-c* contact the wellbore cuttings 108*a,b* for the mud logging equipment 130 to detect the synthesized polymeric nanoparticles 140*a-c* on the surface 144 of the Earth. Specifically, the concentration of the respective synthesized polymeric nanoparticles 140*a-c* in the drilling mud depends on each of the concentrations of the synthesized polymeric nanoparticles 140*a-c* suspended in a solution 142 in the respective tracer tag fluid tank 158*a-c* and on the volumetric flow rate at which that the respective tracer tag fluid 138*a-c* is pumped into the mud pump suction 136 through the injection conduit 134, relative to the drilling mud circulation flow rate produced by the mud pump 114.

The tracer tag fluid 138*a-c* injection flow rate is controlled by the air pressure delivered to an air source 156 (for example, a tank or a compressor) through the conduits 154. The pressure delivered by the air source 156 is constant over time. The tracer tag fluid tanks 138*a*-138*c* can be are pressurized one at a time with the same supply pressure by actuating value 152 described below. Adjusting a pressure of the air source 156 can vary the injection rate of the tracer tag fluid 138*a*-138*c* from the respective buffer tag fluid tank 158*a*-158*c* through the injection manifold 164, into the injection conduit 134, and into the mud pump suction 136.

A volumetric flow-meter 168 can be installed on the injection manifold 164 to measure the volumetric flow rate of the tracer tag fluid 138*a-c* being injected. A signal representing the volumetric flow rate can be sent to the controller 150.

In some implementations, a throttle valve 170 can be positioned in the injection manifold 164. The throttle valve 170 can control the injection flow rate of the tracer tag fluid 138*a-c*. The throttle valve 170 can be set manually. Alternatively, the controller 150 can direct an air compressor coupled to the air source 156 to raise or lower the air pressure in the air source 156. The throttle valve 170 should be operated manually or by pneumatic control of an electrically operated solenoid air valve 152 (located at a distance from the wellbore 106 and the mud pit 116 to minimize the risk of explosion from electrical equipment in proximity to volatile substances off-gassing from the drilling mud). The throttle valve 170 can be used in with the air source 156 to apply a higher air pressure (when compared to multiple lower pressure air sources 156 for each individual tracer tag tank 158*a*-158*c*) and then throttling (reducing) the tracer tag fluid 138*a-c* the fluid flow rate. The throttle valve 170 can be a needle valve.

The controller 150 determines an injection sequence of the tracer tag fluids 138*a-c* into the wellbore 106. The injection sequence includes an injection duration and an injection pause. The injection duration is a time period during which the injection of the tracer tag fluids 138*a-c* occurs. The injection duration is determined by a depth interval of the wellbore to be tagged by the respective plurality of synthesized polymeric nanoparticles. The injection pause is a time period between injection durations. The injection pause prevents mixing of consecutively-injected tracer tag fluids 138*a-c* in the wellbore 106 and on the cuttings 108*a,b*, that is, provides adequate depth and time separation during the drilling and injecting process to clean and flush the wellbore cutting tagging system 100 with a buffer fluid 166, and the drilling assembly 104 and the wellbore 106 with the drilling mud. The controller 150 injects the tracer tag fluids 138*a-c* into the wellbore 106 according to the injection concentrations and the injection sequence.

The controller 150 controls the injection of tracer tag fluids 138*a-c* into the wellbore 106 according to the injection concentration and injection sequence by operating components of the wellbore cutting tagging system 100. The controller 150 injects a single tracer tag fluid 138*a-c* at a time by pressurizing that tracer tag fluid tank 158*a-c* selectively. Specifically, the controller 150 is configured to actuate valves 152 positioned in conduits 154 between a pressurized air source 156 and multiple tracer tag fluid tanks 158*a-c* and a buffer fluid tank 160 containing the buffer fluid 166. The valves 152 can be individually positioned in the conduits 154 or combined in a manifold. The valves 152 can be electrically actuated solenoid air valves. The valves 152 can be coupled to sensors configured to sense valve conditions and transmit signals representing the sensed valve conditions to the controller 150. For example, the sensor can sense the valve 152 open and closed position. The sensors can transmit a signal representing the open and closed sensed valve positions to the controller 150.

The air source 156 is configured to store pressurized air. The air source 156 provides pressurized air through the conduits 154 to pressurize the tracer tag fluid tanks 158*a-c* and buffer fluid tank 160. The air source 156 can include an air compressor to maintain air tank pressure to pressurize the tracer fluid tanks 158*a-c*. In some implementations, the nominal operating pressure of the wellbore cutting tagging system 100 is 100 psi. The wellbore cuttings system 100 can operate at lower or higher pressures. For example, the wellbore cuttings system 100 can operate at 30 to 80 psi or 200-300 psi. The air source 156 is configured to be coupled to sensors configured to sense air source 156 conditions and transmit signals representing the sensed air source 156 conditions to the controller 150. For example, the sensor can sense air source 156 pressure or temperature.

The tracer tag fluid tanks 158*a-c* are configured to be pressurized by the air tank 165. Tracer tag fluid tanks 158*a-c* are fluidically coupled to the air source 156 by conduits 154. The tracer tag fluid tanks 158*a-c* hold the tracer tag fluids 138*a-c*, respectively. The tracer tag fluids 138*a-c* are stored at known concentrations in the tracer tag fluid tanks 158*a-c*. The first tracer tag fluid tank 158*a* holds the first tracer tag fluid 138*a*. The second tracer tag fluid tank 158*b* holds the second tracer tag fluid 138*b*. The third tracer tag fluid tank 158*c* holds the third tracer tag fluid 138*c*. The tracer fluid tanks 158*a-c* are fluidically coupled to an injection manifold 164. The injection manifold 164 is fluidically coupled to the mud pump suction 136 through the injection conduit 134 to inject the multiple tracer tag fluids 138*a-c* into the wellbore 106. The tracer fluid tanks 158*a-c* are configured to be coupled to sensors configured to sense tracer fluid tank 158*a-c* conditions and transmit signals representing the sensed tracer fluid tank 158*a-c* conditions to the controller 150. For example, the sensors can sense tracer fluid tank 158*a-c* pressure, temperature, level, or tracer tag fluid concentration. The tracer fluid tanks 158*a-c* operate at wellbore cutting system 100 nominal operating pressure. The tracer fluid tanks 158*a-c* can be metal or reinforced polymer composite. For example, tracer fluid tanks 158*a-c* can be steel, aluminum, or high density polyethylene with fiberglass or carbon fiber wrapping. In another example, a steel liquid propane storage tank of suitable size can be used. Such tanks are widely available, low-cost, rugged, transportable, and rated for pressures greater than or equal to 250 psi. Tracer fluid tanks 158*a-c* can have the same volume capacity or different volume capacities. For example, the tracer fluid tanks 158*a-c* can have a 5 gallon, 100 gallon, 275 gallon, or 330 gallon capacity. Tracer tag fluid tanks 158*a-c* can be placed close to the mud pump suction 136 to reduce tracer tag fluid 138*a-c* waste and minimize delay in the arrival of tracer fluid pulses into mud pump 114.

The tracer tag fluid tanks 158*a-c* can each include a fill conduit (not shown). The fill conduits can allow additional tracer tag fluids 138*a-c*, for example one of tracer tag fluids 138*a*, 138*b*, or 138*c*, to be added to the respective tracer tag fluid tank 158*a-c*, for example, one of tracer tag fluid tanks 158*a*, 158*b*, 158*c*. The fill conduit can allow for a rapid fill of the tracer tag fluid 138*a-c* to be added to the tracer tag fluid tank 158*a-c* before, during, or after operation of the wellbore cuttings tagging system 100.

The tracer tag fluid tanks 158*a-c* can each include a vent (not shown). The vent can allow a pressure of each tracer tag fluid tank 158*a-c* to be reduced, in other words, pressure vented. Venting can allow for rapid depressurization in the tracer tag fluid tanks 158*a-c* and the injection manifold 164 and improve safety and flow rate of tracer tag fluid 138*a-c* into the tracer tag fluid tanks 158*a-c*.

The buffer fluid tank 160 is configured to hold the buffer fluid 166. The buffer fluid tank 160 is configured to be pressurized by the air source 156. Buffer fluid tank 160 is fluidically coupled to the air source 156 by conduit 154. The buffer fluid tank 160 is fluidically coupled to the injection manifold 164. The injection manifold 164 is fluidically coupled to the mud pump suction 136 through the injection conduit 134 to inject the buffer fluid 166 into the wellbore 106. Buffer fluid 166 is supplied from the buffer fluid tank 160 into the injection manifold 164 to clean the injection manifold 164 of the previously injected tracer tag fluid 138*a-c*. The buffer fluid tank 160 is configured to be coupled to sensors configured to sense buffer fluid tank 160 conditions and transmit signals representing the sensed buffer fluid tank 160 conditions to the controller 150. For example, the sensors can sense buffer fluid tank 160 pressure, temperature, or level. The buffer fluid tank 160 is configured to operate at wellbore cutting system 100 nominal operating pressure. The buffer fluid tank 160 can be metal or polymer. For example, the buffer fluid tank 160 can be steel, aluminum, or high density polyethylene. Multiple buffer fluid tanks 160 can be coupled to the injection manifold 164. The buffer fluid tank 160 can be sized to have different capacities. For example, the buffer fluid tank 160 can have a 100 gallon, 500 gallon, 5000 gallon, or 10000 gallon capacity.

The buffer fluid 166, when injected in the injection manifold 164, separates multiple tracer tag fluids (138*a*, 138*b*, 138*c*) with the buffer fluid 166 to avoid cross-contamination of the different tracer tag fluids (for example 138*a*, 138*b*, or 138*c*) while wellbore cuttings 108*b* are being tagged by the respective synthesized polymeric nanoparticles (140*a*, 140*b*, or 140*c*). The buffer fluid 166 flushes the most recently injected tracer tag fluid (138*a*, 138*b*, or 138*c*) out of the injection manifold 164 and the injection conduit 134 from the tracer tag fluid tanks (158*a*, 158*b*, or 158*c*) into the mud pump 114 and the wellbore 106, thereby providing a repeatable starting condition for the subsequent tracer tag fluid (138*a*, 138*b*, or 138*c*) injected. The injection conduit 134 can be several feet in length, potentially storing a quantity of tracer tag fluid (138*a*, 138*b*, or 138*c*), which will need to flow into the mud pump suction 136. Also, the buffer fluid 166 also provides a fluid force to rapidly shut the respective check valves 162*a-c*, resulting in a sharp transition from an open state for injecting the tracer tag fluids (for example 138*a*, 138*b*, 138*c*) to a closed state for stopping the injection of the tracer tag fluids (for example 138*a*, 138*b*, 138*c*).

The buffer fluid 166 can be water. In some cases, the buffer fluid 166 is a clean oil based mud (for example, no wellbore cuttings 108*a,b* or formation residue from the drilling process). The clean oil based mud buffer fluid 166 is highly miscible with the drilling mud. For example, the buffer fluid 166 can be a diesel-brine invert emulsion.

Valves 162*a-c* are positioned in the injection manifold 164. Valves 162*a-c* are configured to allow flow from the tracer tag fluid tanks 158*a-c* and the buffer fluid tank 160 into the injection conduit 134 and stop flow from the injection conduit 134 back into the tracer tag fluid tanks 158*a-c* and the buffer fluid tank 160. The valves 162*a-c* can be check valves.

As a selected tank, either one of the tracer tag fluid tanks 158*a-c* and/or the buffer fluid tank 160, is aligned to receive the pressurized air by actuating open a respective electrically actuated solenoid air valves 152 to an open position, the pressurized tank (one of the tracer tag fluid tanks 158*a-c* and/or the buffer fluid tank 160) will have a higher in pressure than the other tanks, thereby causing the other respective check-valves 162*a-c* to close swiftly as the selected tank's check valve 162*a-c* opens from the fluid pressure. All the other conduits from the injection manifold 164 to the remaining tracer tag fluid tanks 158*a-c* will be filled with their most recent tracer tag fluid 138*a-c* but will not receive any ingress from the selected tracer tag fluid tank's 158*a-c* fluid, as they will be dead-ended for flow with their check valves 162*a-c* closed.

Figure 2:
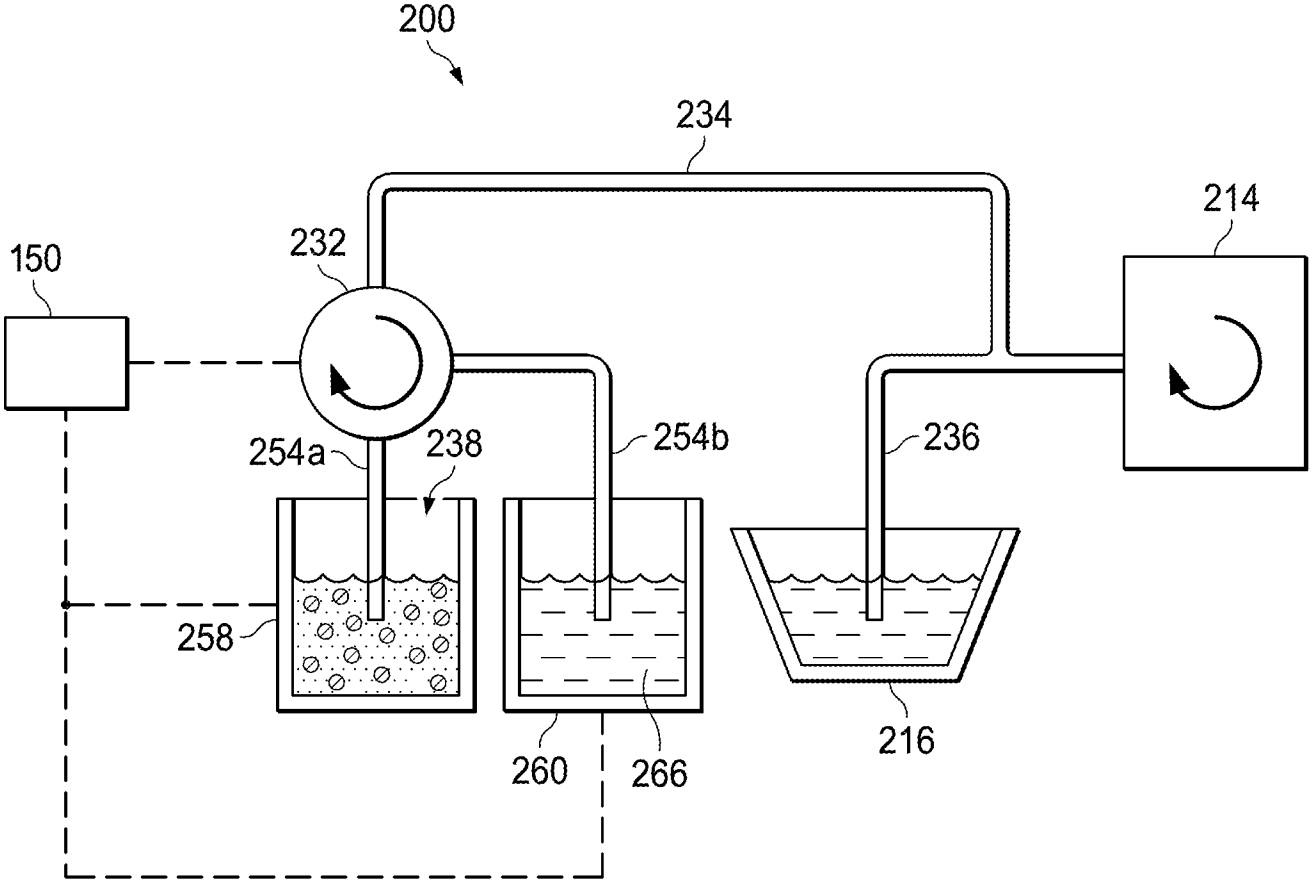
FIG. 2 is a schematic view of another wellbore cuttings tagging system.

FIG. 2 shows another wellbore cuttings tagging system 200 configured to inject a single tracer tag fluid 238 into the wellbore 106. The wellbore cutting tagging system 200 discharges a tracer tag fluid 238 through an injection conduit 234 coupled to the mud pump 214 suction 236 in mud pit 216. The mud pump 214 is connected to a drilling rig substantially similar to drilling rig 102 described earlier. The tracer tag fluid 238 is substantially similar to the tracer tag fluid 138*a-c* described earlier.

The tracer tag fluid tank 258 is fluidically coupled to a pump 232 by conduit 254*a*. The tracer tag fluid tank 258 is configured to hold the tracer tag fluid 238. The tracer tag fluid 238 is stored at known concentrations in the tracer tag fluid tank 238. The tracer fluid tank 258 is not pressurized. The tracer tag fluid tank 258 is similar to the tracer tag fluid tanks 158*a-c* described earlier.

The buffer fluid tank 260 is configured to hold buffer fluid 266. Buffer fluid tank 260 is fluidically coupled to the pump 232 by conduit 254*b* to clean the injection conduit 234 of the previously injected tracer tag fluid 238 as described earlier. The buffer fluid tank 260 is similar to the buffer fluid tank 160 described earlier.

The pump 232 has a pump suction 236 fluidically coupled to the tracer tag fluid tank 258 and the buffer fluid tank 260 to draw buffer fluid 266 from the tracer tag fluid tank 258 and the buffer fluid tank 260. The pump 232 has a pump discharge 268 fluidically coupled the injection manifold 234 and configured into inject the tracer tag fluid 238 into the wellbore. The pump 232 can be a reciprocating pump. The pump 232 can be powered electrically or pneumatically.

Figure 3B:
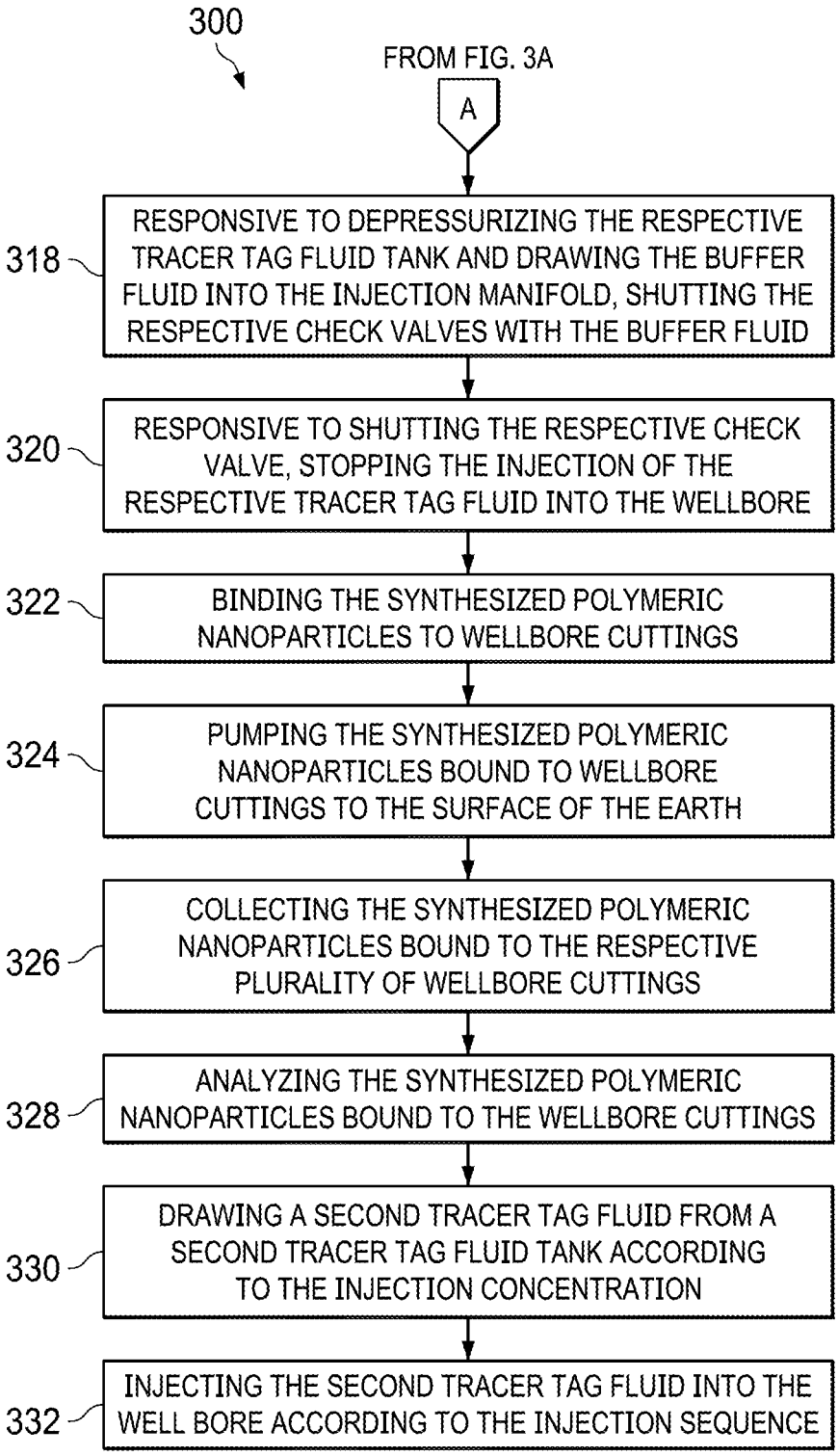
FIG. 3B is a continuation of the flow chart of the example method of FIG. 3A.

FIG. 3 is a flow chart of an example method 300 of injecting multiple tracer tag fluids into a wellbore. At 302, injection concentrations of respective tracer tag fluids are determined. Each of the respective tracer tag fluids include respective synthesized polymeric nanoparticles suspended in respective solutions. The respective synthesized polymeric nanoparticles are configured to bind to respective wellbore cuttings. The respective synthesized polymeric nanoparticles are configured to undergo a thermal de-polymerization at a respective temperature. Thermal de-polymerization of the respective synthesized polymeric nanoparticles generates a respective mass spectra.

At 304, an injection sequence into the wellbore of the respective tracer tag fluids is determined. The injection sequence includes an injection duration and an injection pause. The injection duration is determined by a depth interval of the wellbore to be tagged by the respective plurality of synthesized polymeric nanoparticles. The injection pause prevents mixing the tracer tag fluids in the wellbore.

At 306, each of the respective tracer tag fluids at respective known concentrations are stored in tracer tag fluid tanks. At 308, buffer fluid is stored in a buffer fluid tank.

At 310, a tracer tag fluid is drawn from the respective tracer tag fluid tank according to the injection sequence. The tracer tag fluid can be drawn from the tracer tag fluid tank by electrically actuating a respective solenoid air valve positioned in respective conduits fluidically connecting an air tank to the respective tracer tag fluid tanks. The air tank is configured to pressurize the respective tracer tag fluid tanks when the respective electrically actuated solenoid air valves are opened according to the injection sequence. The tracer tag fluid may be mixed with a hydrophilic co-monomer or ionic surfactant to make the tracer tag fluid compatible with a water based mud. The tracer tag fluid may be reverse emulsified to make the tracer tag fluid compatible with an oil based mud.

At 312, responsive to pressurizing the respective tracer tag fluid tank, a respective check valve positioned in a respective second conduit fluidically connecting the respective tracer tag fluid tank to the wellbore is opened. At 314, the respective check valve is maintained open for the injection duration to inject the respective tracer tag fluid into the wellbore.

At 316, the electrically actuated solenoid air valve is shut to depressurize the respective tracer tag fluid tank. Simultaneously, buffer fluid is drawn from the buffer fluid tank into an injection manifold. The buffer fluid can be drawn from the buffer fluid tank by electrically actuating a respective solenoid air valve positioned in a conduit fluidically connecting an air tank to the buffer fluid tank. The air tank is configured to pressurize buffer fluid tank when the respective electrically actuated solenoid air valve is opened according to the injection sequence. At 318, responsive to depressurizing the respective tracer tag fluid tank and drawing the buffer fluid into the injection manifold, the respective check valves is shut. At 320, responsive to shutting the respective check valve, the injection of the respective tracer tag fluid into the wellbore is stopped.

At 322, the synthesized polymeric nanoparticles bind to wellbore cuttings. At 324, the synthesized polymeric nanoparticles bound to wellbore cuttings are pumped to the surface of the Earth. At 326, the synthesized polymeric nanoparticles bound to the respective plurality of wellbore cuttings are collected. At 328, the synthesized polymeric nanoparticles bound to the wellbore cuttings are analyzed. The synthesized polymeric nanoparticles bound to the wellbore cuttings cab be analyzed with a gas chromatography—mass spectrometry instrument including a pyrolyzer.

At 330, a second tracer tag fluid is drawn from a second tracer tag fluid tank according to the injection concentration. At 332, the second tracer tag fluid is injected into the wellbore according to the injection sequence.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A wellbore cuttings tagging system comprising:

a plurality of tracer tag fluid tanks configured to store each of a respective plurality of tracer tag fluids at a plurality of respective known concentrations, wherein each respective plurality of tracer tag fluids comprises a respective plurality of synthesized polymeric nanoparticles suspended in a respective solution, the respective plurality of synthesized polymeric nanoparticles configured bind to a respective wellbore cutting when the plurality of tracer tag fluids have been injected into a wellbore containing the respective wellbore cutting, wherein the respective plurality of synthesized polymeric nanoparticles is configured to undergo a thermal de-polymerization at a respective temperature, the respective temperature increased by mud logging analysis equipment, and wherein thermal de-polymerization of the respective plurality of synthesized polymeric nanoparticles generates a respective mass spectra detectable by the mud logging analysis equipment;

a buffer fluid tank configured to store a buffer fluid;

an air tank configured to store pressurized air;

a first plurality of valves positioned in a respective first plurality of conduits fluidically connecting the air tank to the respective tracer tag fluid tanks and the buffer fluid tank;

a second plurality of valves positioned in a respective second plurality of conduits fluidically configured to connect the plurality of tracer tag fluid tanks to the wellbore and the buffer fluid tank, the second plurality of valves configured to allow flow from the plurality of tracer tag fluid tanks and the buffer fluid tank into the wellbore and stop flow from the wellbore into the plurality of tracer tag fluid tanks and the buffer fluid tank; and a controller configured to perform operations comprising:

determining a plurality of injection concentrations of the respective plurality of tracer tag fluids;

determining an injection sequence of the respective plurality of tracer tag fluids into a wellbore, the injection sequence comprising:

an injection duration, wherein the injection duration is determined by a depth interval of the wellbore to be tagged by the respective plurality of synthesized polymeric nanoparticles; and an injection pause, wherein the injection pause prevents mixing the plurality of tracer tag fluids in the wellbore; and based on the determined injection concentrations and injection durations, injecting the respective plurality of tracer tag fluids into the wellbore, according to the plurality of injection concentrations and the injection sequence.

2. The wellbore cuttings tagging system of claim 1, wherein injecting the respective plurality of tracer tag fluids into the wellbore, according to the plurality of injection concentrations and the injection sequence comprises actuating the first plurality of valves and the second plurality of valves.

3. The wellbore cuttings tagging system of claim 2, wherein the first plurality of valves are electrically actuated solenoid air valves.

4. The wellbore cuttings tagging system of claim 3, wherein actuating the respective plurality of valves further comprises:

opening a respective plurality of electrically actuated solenoid air valves positioned in a respective plurality of conduits, the respective plurality of conduits fluidically connecting an air tank to the plurality of tracer tag fluid tanks, wherein the air tank is configured to pressurize the respective plurality of tracer tag fluid tanks when the respective plurality of electrically actuated solenoid air valves are opened, wherein each of the plurality of electrically actuated solenoid air valves are configured to control a pressure of the air flowing from the air tank to the respective tracer tag fluid tank;

responsive to pressurizing the respective plurality of tracer tag fluid tanks, opening a respective plurality of check valves positioned in a respective second plurality of conduits fluidically connecting the respective plurality of tracer tag fluid tanks to the wellbore;

maintaining the respective plurality of check valves open for the injection duration to inject the respective plurality of tracer tag fluids into the wellbore;

shutting the respective plurality of electrically actuated solenoid air valves, wherein the respective plurality of tracer tag fluid tanks depressurize when the electrically actuated solenoid air valves shut;

simultaneously while shutting the respective plurality of electrical actuated solenoid air valves, opening an electrically actuated solenoid air valve positioned in a buffer fluid conduit, the buffer fluid conduit fluidically connecting a buffer fluid tank to the wellbore, wherein the air tank is configured to pressurize the buffer fluid tank when the electrically actuated solenoid air valve in the buffer fluid conduit is opened;

responsive to depressurizing the respective plurality of tracer tag fluid tanks and simultaneously opening the electrically actuated solenoid air valve; shutting the respective plurality of check valves open to inject the respective plurality of tracer tag fluids into the wellbore; and responsive to shutting the respective plurality of check valves, stopping injection of the plurality of tracer tag fluids into the wellbore.

5. The wellbore cuttings tagging system of claim 3, further comprising a throttle valve positioned in an injection manifold fluidically coupling the plurality of tracer tag fluid tanks to the wellbore, wherein the throttle valve is configured to control a flow of the plurality of tracer tag fluids from the respective tracer tag fluid tanks through the injection manifold into the wellbore.

6. The wellbore cuttings tagging system of claim 5, actuating the respective plurality of valves further comprises:

opening a respective plurality of electrically actuated solenoid air valves positioned in a respective plurality of conduits, the respective plurality of conduits fluidically connecting an air tank to the respective plurality of tracer tag fluid tanks, wherein the air tank is configured to pressurize the respective plurality of tracer tag fluid tanks when the respective plurality of electrically actuated solenoid air valves are opened;

responsive to pressurizing the respective plurality of tracer tag fluid tanks, opening a respective plurality of check valves positioned in a respective second plurality of conduits fluidically connecting the respective plurality of tracer tag fluid tanks to the wellbore;

maintaining the respective plurality of check valves open for the injection duration to inject the respective plurality of tracer tag fluids into the wellbore;

throttling, by the throttle valve positioned in the injection manifold fluidically coupling the tracer tag fluid tanks to the wellbore, the flow of the respective plurality of tracer tag fluids from the respective tracer tag fluid tanks through the injection manifold into the wellbore;

shutting the respective plurality of electrically actuated solenoid air valves, wherein the respective plurality of tracer tag fluid tanks depressurize when the electrically actuated solenoid air valves shut;

simultaneously while shutting the respective plurality of electrical actuated solenoid air valves, opening an electrically actuated solenoid air valve positioned in a buffer fluid conduit, the buffer fluid conduit fluidically connecting a buffer fluid tank to the wellbore, wherein the air tank is configured to pressurize the buffer fluid tank when the electrically actuated solenoid air valve in the buffer fluid conduit is opened;

responsive to depressurizing the respective plurality of tracer tag fluid tanks and simultaneously opening electrically actuated solenoid air valve; shutting the respective plurality of check valves open to inject the respective plurality of tracer tag fluids into the wellbore; and responsive to shutting the respective plurality of check valves, stopping injection of the plurality of tracer tag fluids into the wellbore.

7. The wellbore cuttings tagging system of claim 5, further comprising a mud system fluidly coupled to the injection manifold, the mud system comprising a water-based mud and a hydrophilic co-monomer, the mud system configured to mix the hydrophilic co-monomer with the respective plurality of tracer tag fluids to make the respective plurality of tracer tag fluids compatible with the water-based mud.

8. The wellbore cuttings tagging system of claim 5, further comprising a mud system fluidly coupled to the injection manifold, the mud system comprising a water-based mud and an ionic surfactant, the mud system configured to mix the ionic surfactant with the respective plurality of tracer tag fluids to make the respective plurality of tracer tag fluids compatible with the water-based mud.

9. The wellbore cuttings tagging system of claim 5, further comprising a mud system fluidly coupled to the injection manifold, the mud system comprising an oil-based mud, the mud system configured to reverse emulsify the respective plurality of tracer tag fluids to make the respective plurality of tracer tag fluids compatible with the oil-based mud.

10. The wellbore cuttings tagging system of claim 1, wherein the mud logging analysis equipment is configured to receive and analyze the respective plurality of synthesized polymeric nanoparticles from the wellbore.

11. The wellbore cuttings tagging system of claim 10, wherein the mud logging analysis equipment comprises a gas chromatography—mass spectrometry instrument including a pyrolyzer configured to analyze the synthesized polymeric nanoparticles bound to the respective plurality of wellbore cuttings.

12. The wellbore cuttings tagging system of claim 1, wherein the controller is a non-transitory computer-readable storage medium storing instructions executable by one or more computer processors, the instructions when executed by the one or more computer processors cause the one or more computer processors to determine a plurality of injection concentrations of a respective plurality of tracer tag fluid, determine an injection sequence of the respective plurality of tracer tag fluids into a wellbore, and inject the respective plurality of tracer tag fluids into the wellbore according to the plurality of injection concentrations and the injection sequence.

* * * * *